US009989318B2

(12) United States Patent
Kainu

(10) Patent No.: US 9,989,318 B2
(45) Date of Patent: Jun. 5, 2018

(54) THERMAL DEVICE, ITS USE, AND METHOD FOR HEATING A HEAT TRANSFER MEDIUM

(71) Applicant: VALMET TECHNOLOGIES OY, Espoo (FI)

(72) Inventor: Vesa Kainu, Kangasala (FI)

(73) Assignee: VALMET TECHNOLOGIES OY, Espoo (FI)

( * ) Notice: Subject to any disclaimer, the term of this patent is extended or adjusted under 35 U.S.C. 154(b) by 136 days.

(21) Appl. No.: 15/028,700

(22) PCT Filed: Sep. 29, 2014

(86) PCT No.: PCT/FI2014/050736
§ 371 (c)(1),
(2) Date: Apr. 11, 2016

(87) PCT Pub. No.: WO2015/052372
PCT Pub. Date: Apr. 16, 2015

(65) Prior Publication Data

US 2016/0258692 A1 Sep. 8, 2016

(30) Foreign Application Priority Data

Oct. 11, 2013 (FI) ..... 20136013

(51) Int. Cl.
*F28F 1/12* (2006.01)
*F22B 37/06* (2006.01)
*F22B 31/00* (2006.01)

(52) U.S. Cl.
CPC ..... *F28F 1/12* (2013.01); *F22B 31/0007* (2013.01); *F22B 31/0015* (2013.01); *F22B 37/06* (2013.01)

(58) Field of Classification Search
CPC ..... F28F 1/10; F28F 1/12; F22B 37/06; F22G 5/00
(Continued)

(56) References Cited

U.S. PATENT DOCUMENTS 2,416,674 A * 3/1947 Bailey ..... F22G 5/16 122/459
4,177,765 A 12/1979 Wehrmeister
(Continued)

FOREIGN PATENT DOCUMENTS

EP 0878464 A1 11/1998
EP 2071239 A2 6/2009
(Continued)

OTHER PUBLICATIONS

International Search Report for PCT/FI2014/050736 dated Mar. 31, 2015.
(Continued)

*Primary Examiner* — Robert A Hopkins
(74) *Attorney, Agent, or Firm* — Stiennon & Stiennon

(57) ABSTRACT

A heat exchanger pipe in a flow duct for gases. The pipe first section has a second section with an inner pipe for transferring heat transfer medium; an outer pipe that radially encloses a part of the inner pipe; and a medium layer between the outer pipe and the part of the inner pipe. The second section of the heat exchanger pipe bends less than 90 degrees. Furthermore, the first section is insulated in its entirety, or non-insulated in the vicinity of other heat recovery surfaces only. In the device the temperature of the heat transfer medium flowing in the inner pipe is at least 500° C., the temperature of the outer surface of the outer pipe is higher than 600° C., or an auxiliary agent is fed to the thermal device.

21 Claims, 7 Drawing Sheets

(58) Field of Classification Search
USPC ..... 122/459
See application file for complete search history.

(56) References Cited

U.S. PATENT DOCUMENTS

| | | | |
|---|---|---|---|
| 2007/0157859 | A1 | 7/2007 | Inomata et al. |
| 2010/0000474 | A1 | 1/2010 | Petänen et al. |
| 2010/0101511 | A1 | 4/2010 | Nordh |

FOREIGN PATENT DOCUMENTS

| | | | |
|---|---|---|---|
| JP | H0790534 | A | 4/1995 |
| JP | 2001330207 | A | 11/2001 |
| WO | 2006070075 | A2 | 7/2006 |
| WO | 2008111885 | A1 | 9/2008 |
| WO | 2011131842 | A2 | 10/2011 |

OTHER PUBLICATIONS

Written Opinion of the International Searching Authority for PCT/FI2014/050736 dated Mar. 31, 2015.
International Preliminary Report on Patentability for PCT/FI2014/050736 dated Sep. 22, 2015.
Response to the Written Opinion for PCT/FI2014/050736 dated Jul. 13, 2015.
Finnish Patent and Registration Office Search Report for FI20136013 dated May 7, 2014.
Finnish Search Report for FI 20155716 dated Oct. 18, 2016.

* cited by examiner

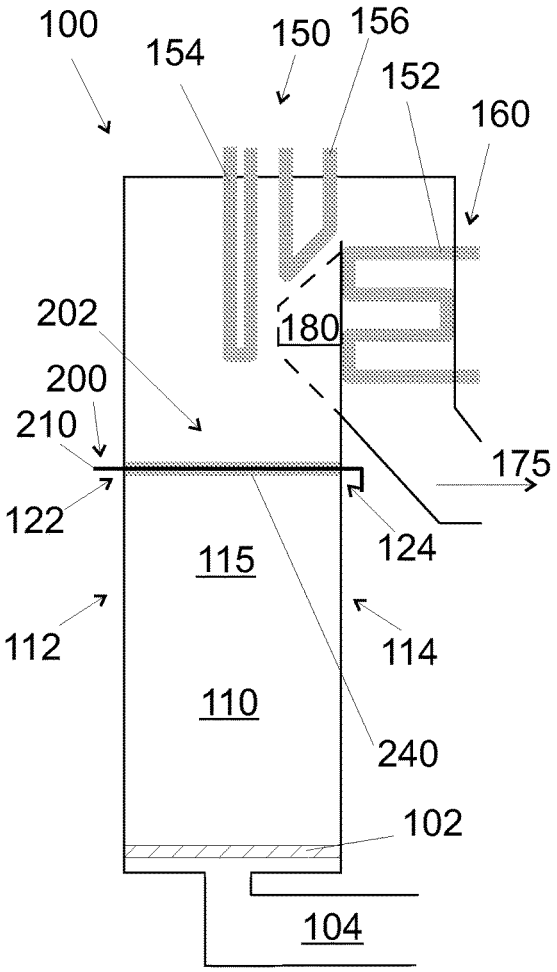
Fig. 1a
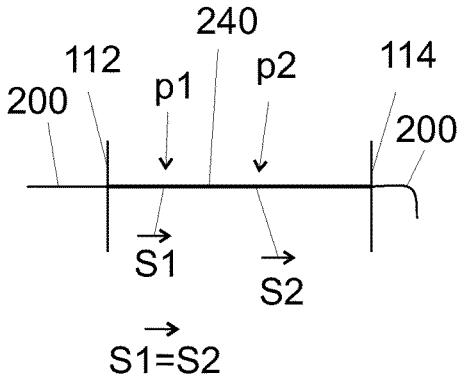
Fig. 1h1
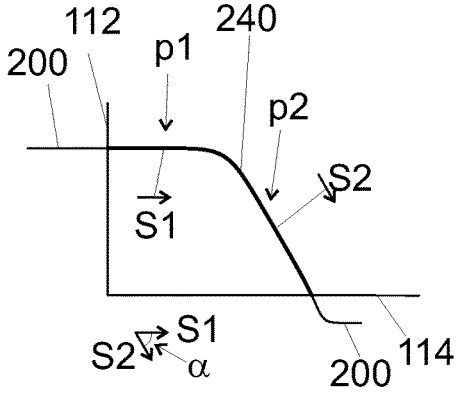
Fig. 1h2
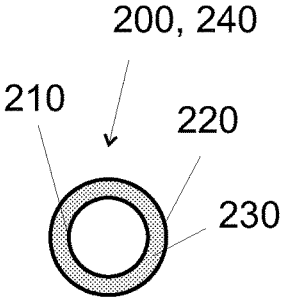
Fig. 1g1
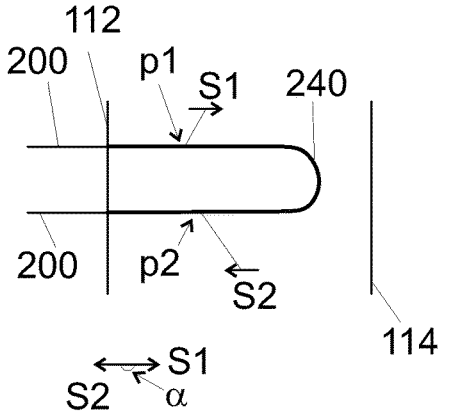
Fig. 1h3

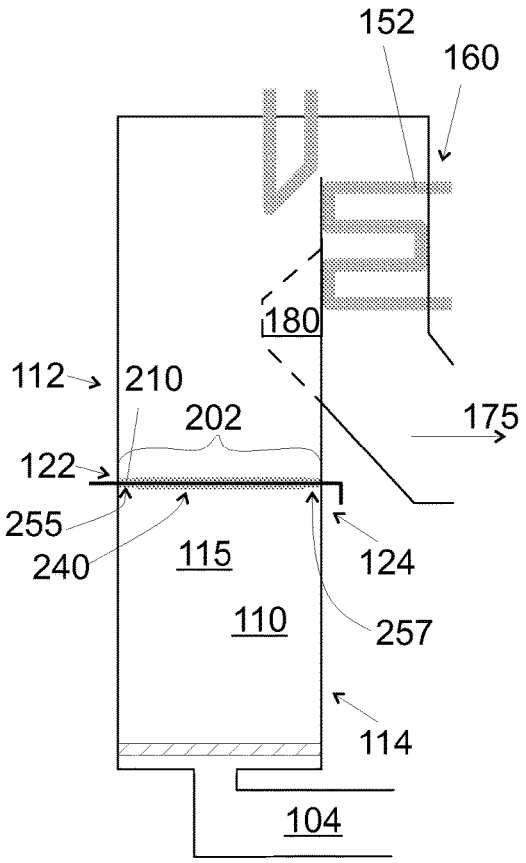
Fig. 1b
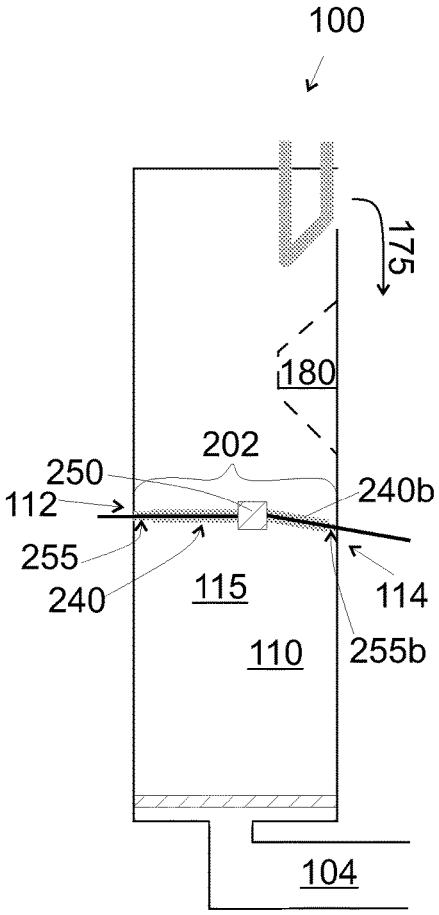
Fig. 1c
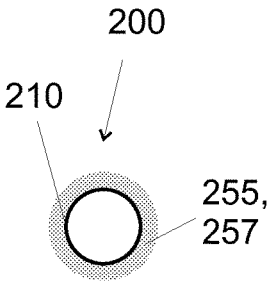
Fig. 1g2
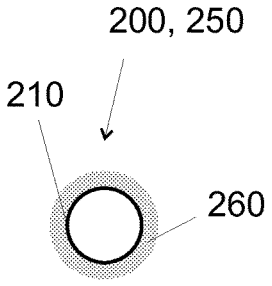
Fig. 1g3
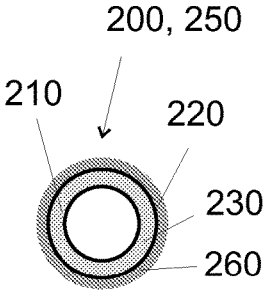
Fig. 1g4

THERMAL DEVICE, ITS USE, AND METHOD FOR HEATING A HEAT TRANSFER MEDIUM

CROSS REFERENCES TO RELATED APPLICATIONS

This application is US national stage application of International App. No PCT/FI2014/050736 filed on Sep. 29, 2014, which claims priority on Finnish Application No. 20136013, filed on Oct. 11, 2014, the disclosures of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to thermal devices, such as gasification reactors and boilers, particularly fluidized bed boilers, such as bubbling fluidized bed boilers. The invention relates to thermal devices for heating a heat transfer medium. In particular, the invention relates to thermal devices for heating a heat transfer medium, such as steam, to a very high temperature.

Boilers are used for burning combustible material and thereby for producing energy, such as heat. Heat is recovered from the heat transfer surfaces of the boiler by a heat transfer medium, such as water and/or steam. Hot steam can be used to generate electricity, for example by means of steam turbines.

The efficiency of generating energy is improved when the temperature of the heated heat transfer medium is raised. However, some challenges are involved in increasing the temperature. Increasing the temperature will inevitably increase the temperature of the outer surfaces of the heat transfer pipes. Because corrosive substances, such as salts, are condensed on the surfaces, and an increase in the temperature generally accelerates chemical reactions, corrosion is significantly accelerated due to the increase in the temperature.

Furthermore, for producing particularly hot heat transfer medium, the heat transfer pipe for recovering heat should be placed in a very hot environment. The pressure inside the heat transfer pipe is usually considerable (for example, dozens of bars, typically higher than 30 bar); for example, the pressure and the temperature may correspond to the pressure of saturated vapour, at least at low temperatures. At higher temperatures, the steam is normally superheated, wherein its temperature is higher than the temperature of saturated steam at a corresponding pressure, or the temperature of the critical point of the heat transfer medium, i.e. the critical temperature. (374° C. for water), is exceeded. The heat transfer pipe used in such a hot environment has to withstand the pressure prevailing inside the pipe and also the loads from the corrosive environment outside the pipe. Heat transfer pipes which are resistant to a hot environment and a high pressure under corrosive conditions are typically very expensive options.

Protected heat transfer pipes for a loopseal superheater are disclosed in US 2010/0000474. Therein, the superheating piping includes a steam pipe where the steam to be superheated is directed, and the steam pipe is separated by a protective shell. Such a superheater is preferably placed inside a loopseal. Same principles can be applied for a radiant superheater or a superheater arranged in a flue gas channel.

A device and method for altering the heat transfer characteristics of tubes exposed to the heat generated within a boiler is disclosed in U.S. Pat. No. 4,177,765. Therein a fluidized bed boiler is equipped with a plurality of slidable sleeves circumscribing the vapor generator tubes disposed therein. By selectively extending or retracting the sleeves over the tubes, the heat transfer characteristics can be altered.

SUMMARY OF THE INVENTION

It is an aim of the present invention to provide a thermal device, such as a gasification reactor or a boiler, for heating a heat transfer medium to a high temperature and simultaneously to apply conventional materials.

In an embodiment, the thermal device comprises at least a first wall delimiting a flow duct for gases, and a heat exchanger pipe comprising at least an inner pipe, at least a first section of said heat exchanger pipe being placed in said flow duct for gases and extending from said first wall to said first wall or to a second wall delimiting the flow duct for gases in said flow duct for gases, and said first section of the heat exchanger pipe comprising a second section of the heat exchanger pipe, which extends in said flow duct for gases.

In the thermal device, the second section of the heat exchanger pipe comprises at least a section of the inner pipe, for transferring heat transfer medium from the first end to the second end of the inner pipe and for recovering heat by the heat transfer medium, an outer pipe which radially encloses said section of the inner pipe, and a layer of medium left between said outer pipe and said section of the inner pipe in the radial direction.

Furthermore, (A,i)

the inner pipe of the first section of said heat exchanger pipe is noninsulated in one or more noninsulated areas in such a way that the distance from all the points of the noninsulated areas in the first section of the heat exchanger pipe to the other heat transfer surfaces of the thermal device (except for the heat exchanger pipe itself) is not greater than 15 cm; or (A,ii)

the inner pipe of the first section of said heat exchanger pipe is, over its entire length, insulated from the flow duct for gases by means of said outer pipe and/or an insulator.

In an embodiment, the thermal device comprises several other heat transfer pipes inside the walls of the flow duct for gases, for recovering heat. Said heat exchanger pipe and said other heat transfer pipes constitute a continuous flow duct for the heat transfer medium, for heating the heat transfer medium.

Furthermore, in one such embodiment, (B,i)

said flow duct for the heat transfer medium comprises the first section of said heat exchanger pipe as the last heat transfer element placed in the flow duct of gases, in the direction of the flow of the heat transfer medium, or (B,ii)

said flow duct for the heat transfer medium comprises the last first section of the heat exchanger pipe placed in the flow duct for gases, in the direction of flow of the heat transfer medium, and at least one heat transfer pipe in the flow duct for gases, placed downstream in the direction of flow of the heat transfer medium, and said last first section of the heat exchanger pipe is arranged, in the flow direction of the gas flowing outside the outer pipe, upstream of said heat transfer pipes in the flow duct for gases, placed downstream in the flow direction of the heat transfer medium.

Preferably, said second section of the heat exchanger pipe extends in a straight line or bends less than 90 degrees.

In an embodiment, said second section of the heat exchanger pipe bends at least 90 degrees and thereby does not extend in a straight line.

The thermal device can be used, for example, for heating steam. In an embodiment of the use of the thermal device, the heat transfer medium is allowed to flow in said inner pipe, steam is used as the heat transfer medium, and the temperature of the heat transfer medium flowing in the inner pipe is at least 500° C., preferably at least 530° C.

The thermal device can be used for heating the heat transfer medium in such a way that the surface temperature of a heat exchanger pipe in operation is considerably high. Thus, condensation of corrosive substances on the surface of the pipe is prevented or at least reduced. In an embodiment of the use, the temperature of the outer surface of the outer pipe exceeds 600° C.

Furthermore, in the presented boiler, the use of auxiliary agents for combustion is intensified when the means for supplying the auxiliary agent are placed in such a location where the operating temperature is typically favourable to the supply of the auxiliary agent.

The use of the thermal device will lead to performing a method. A corresponding method for heating a heat transfer medium comprises producing gas heated by a thermal device, conveying said gas into a flow duct for gases, conveying heat transfer medium into a heat exchanger pipe comprising at least an inner pipe, at least the first section of the heat exchanger pipe being placed in the flow duct for gases and extending in said flow duct for gases from the wall of said flow duct to the same or another wall of said flow duct, and said first section of the heat exchanger pipe comprising a second section of the heat exchanger pipe, extending in said flow duct for gases, and recovering heat by the heat transfer medium in the heat exchanger pipe.

In the method, the second section of the heat exchanger pipe comprises at least a section of the inner pipe for transferring heat transfer medium from the first end to the second end of the inner pipe and for recovering heat by the heat transfer medium, an outer pipe which radially encloses said section of the inner pipe, and a layer of medium left, in the radial direction, between said outer pipe and said section of the inner pipe.

Furthermore, (A,i)

the inner pipe of the first section of said heat exchanger pipe is noninsulated from the flow duct for gases in one or more noninsulated areas in such a way that the distance from all the points of the noninsulated areas in the first section to the other heat transfer surfaces of the thermal device is not greater than 15 cm; or (A,ii)

the inner pipe of the first section of said heat exchanger pipe is, over its entire length, insulated from the flow duct for gases by means of said outer pipe and/or an insulator.

In an embodiment of the method, too, the thermal device comprises several other heat transfer pipes inside the walls of the flow duct for gases, for recovering heat. Said heat exchanger pipe and said other heat transfer pipes constitute a continuous flow duct for the heat transfer medium, for heating the heat transfer medium.

In such an embodiment of the method, (B,i)

said flow duct for the heat transfer medium comprises the first section of said heat exchanger pipe as the last heat transfer element placed in the flow duct of gases, in the direction of the flow of the heat transfer medium, or (B,ii)

said flow duct for the heat transfer medium comprises the last first section of the heat exchanger pipe placed in the flow duct for gases, in the direction of flow of the heat transfer medium, and at least one heat transfer pipe in the flow duct for gases, placed downstream in the direction of flow of the heat transfer medium, and said last first section of the heat exchanger pipe is arranged, in the flow direction of the gas flowing outside the outer pipe, upstream of said subsequent heat transfer pipes placed in the flow duct for gases, in the flow direction of the heat transfer medium.

Preferably, said second section of the heat exchanger pipe extends in a straight line or bends less than 90 degrees.

In an embodiment of the method, said second section of the heat exchanger pipe bends at least 90 degrees and thereby does not extend in a straight line.

BRIEF DESCRIPTION OF THE DRAWINGS

FIG. 1*a* shows a thermal device in a side view,

FIG. 1*b* shows a thermal device in a side view,

FIG. 1*c* shows a thermal device in a side view,

FIGS. 1*g*1 to 1*g*4 show cross-sectional views of a heat exchanger pipe at different points thereof in a flow duct for gases in a thermal device, FIGS. 1*h*1 to 1*h*3 show straight and curved second sections of a heat exchanger pipe.

DESCRIPTION OF THE PREFERRED EMBODIMENTS

Figure 1D:
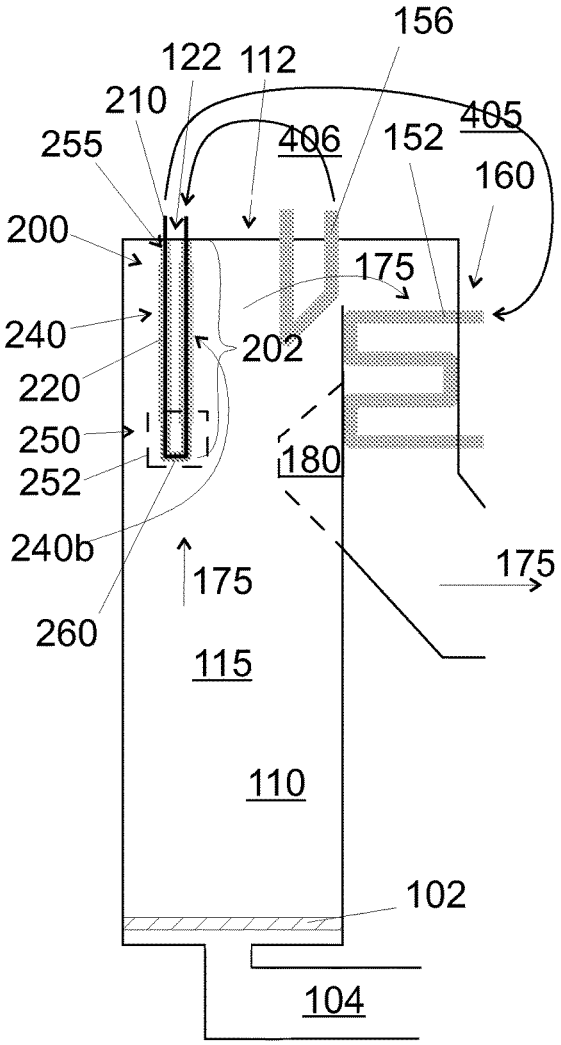
FIG. 1*d* shows a thermal device in a side view.

Thermal devices are used for generating energy, such as electricity and/or heat, and/or for producing fuel from combustible material, such as municipal waste and/or raw material of biological origin, such as wood based raw material. For example, the thermal device may refer to a boiler in which combustible material is burnt for producing energy. Boilers can be classified according to the material to be burnt, wherein e.g. the following boilers are known: soda recovery boiler (fired with black liquor), oil fired boiler, coal fired boiler, pulverized fuel boiler, and waste fired boiler (in a waste-to-energy power plant). Boilers can be classified according to the structure of the boiler, wherein e.g. the following boilers are known: fluidized bed boiler, such as circulating fluidized bed boiler (CFB) and bubbling fluidized bed boiler (BFB); grate boiler; water-pipe boiler; and fire-pipe boiler. For example, the thermal device may refer to a gasification reactor, in which combustible material is oxidized to produce synthesis gas. Synthesis gas can be further refined to fuel, such as biofuel. For example, the thermal device may refer to a pyrolysis reactor, in which combustible material is pyrolyzed to produce pyrolysis oil. The pyrolysis oil can be further refined. Moreover, the thermal device may refer to a torrefaction reactor, in which combustible material is thermally treated to evaporate water and light hydrocarbons from the combustible material. The combustible material treated in this way can be later used as fuel in subsequent processes. In a corresponding way, the thermal process refers to a process in which energy and/or fuel is produced. In alignment with the above described reactors, the thermal process may be, for example, a combustion, gasification, pyrolysis, or torrefaction process. The above mentioned combustible material may be, for example, solid material of biological origin, such as wood based material.

Boilers are given here as an example of thermal devices and their use. Boilers are used for burning combustible material and thereby for producing energy, such as heat. Heat is recovered from the heat transfer surfaces of the boiler by a heat transfer medium, such as water and/or steam. Hot steam can be used to generate electricity, for example by means of steam turbines.

A gasification reactor is given as a second example of thermal devices and their use. Gasification reactors are used to oxidise combustible material in oxygen deficient conditions, for producing synthesis gas. Heat can be recovered from the synthesis gas. Heat is recovered from the heat transfer surfaces of the gasification reactor by a heat transfer medium, such as water and/or steam. Hot steam can be used to generate electricity, for example by means of steam turbines.

Pyrolysis reactors are given as a third example of thermal devices and their use. They are used for forming pyrolysis steam which can be condensed. In the condensing, heat can be recovered in the above described way.

The efficiency of energy production is improved when the temperature of the heated heat transfer medium is raised. Water and/or steam is normally used as the heat transfer medium. In the present description, steam also refers to steam at a temperature exceeding the critical point of water (373° C.), which steam is sometimes call gas, because the steam at said temperature cannot be liquefied to water by increasing the pressure.

Thermal devices, such as boilers, comprise walls, which delimit, for example, a furnace, the gasification phase of the gasification reactor, and/or various gas ducts, such as flue gas ducts, synthesis gas ducts, or pyrolysis steam ducts. The term "wall" may refer to, for example, the walls or the ceiling of the reactor. Thermal reactors also comprise heat exchangers for recovering heat generated in the reactions. The surface temperature of the heat exchanger in operation has a significant effect on the corrosion of the surface of the heat exchanger. Basically, if said surface temperature is low, corrosive substances are condensed from the gases into solids. At the low temperature, the solids do not significantly corrode the surfaces. On the other hand, if said surface temperature is high, no significant amounts of corrosive substances are condensed from the gases, wherein the corrosion is relatively slow, too. In between, a range is left in which corrosive substances are condensed from the gases into liquid substances onto the heat recovery surfaces, wherein the corrosion is very rapid. The values of these temperatures will be given in more detail further below.

Raising the surface temperature of the heat exchanger pipe is very challenging, because the pipe has to withstand the pressure prevailing inside it at the operating temperature.

The present invention will be illustrated in the appended drawings. The figures, such as FIGS. 1*a* and 1*g*1, show a thermal device comprising at least a first wall 112 delimiting a flow duct 115 for gases, and a heat exchanger pipe 200 comprising at least an inner pipe 210, at least the first section 202 of said heat exchanger pipe being placed in said flow duct 115 for gases and extending in said flow duct 115 for gases from said first wall 112 to said first wall 112 or to a second wall 114 (FIGS. 1*a* to 1*e*) delimiting the flow duct for gases, and said first section 202 of the heat exchanger pipe comprising a second section 240 of the heat exchanger pipe, extending in said flow duct 115 for gases.

In this context, the "heat exchanger pipe" thus refers to a possibly long pipe whose (at least one) first section 202 is, over its entire length, placed in the flow duct 115 for gases. In a corresponding manner, the first section 202 refers to a continuous section of the pipe that is as long as possible and extends in the flow duct; that is, a section that extends from wall to wall (either the same or another wall). The second section 240 of the heat exchanger pipe, comprised in said first section 202, is a shielded assembly in which an inner pipe 210 is shielded by an outer pipe 220. The second section 240 may be shorter than the first section 202, or equal in length. FIG. 1*g*1 illustrates the structure of the second section 240 of such a heat exchanger pipe.

With reference to FIG. 1*g*1, in the presented embodiments, the second section 240 of the heat exchanger pipe comprises at least a section of the inner pipe 210 for transferring heat transfer medium from the first end to the second end of the inner pipe and for recovering heat by the heat transfer medium, an outer pipe 220 which radially encloses said section of the inner pipe, and a layer 230 of medium left between said outer pipe 220 and said section of the inner pipe 210 in the radial direction.

Such a structure has the advantage that because of the medium layer 230, the surface temperature of the outer pipe 220 is, when the thermal device is in operation, so high that no significant amounts of corrosive substances are condensed on its surface. Such a pipe with a layered structure is heavier than a single layered pipe. Furthermore, it has been found that if a pipe with a layered structure is bent, the outer pipe will come into contact with the inner pipe, wherein there will be no medium layer at the bending point. When there is no medium layer, heat will be conducted too well from the outer pipe to the inner pipe, which will reduce the surface temperature of the outer pipe to a range that is critical for corrosion, at least when the present configuration is applied in hot conditions and with a hot heat transfer medium. Furthermore, a relatively straight pipe is easier to make self-supporting than a pipe that bends to a great extent. For these reasons, in an advantageous embodiment, said second section 240 of the heat exchanger pipe extends in a straight line or bends less than 90 degrees.

It has been discovered that with some technical solutions, it is possible to arrange the inner pipe 210 inside the outer pipe 220, even when the outer and inner pipes are bent, in such a way that a medium layer sufficient for heat insulation is left between these pipes.

In an embodiment, said second section 240 of the heat exchanger pipe is bent at least 90 degrees, wherein said second section of the heat exchanger pipe does not extend in a straight line. Also in this case it is possible, by applying certain technical solutions, to provide a medium layer constituting a sufficient heat insulation between the outer pipe 220 and the inner pipe 210.

The function of the outer pipe 220 is, among other things, to shield the inner pipe 210. It is possible that in addition to the outer pipe 220 (FIGS. 1*c* and 1*g*4) or as an alternative to the outer pipe 220 (FIGS. 1*b* and 1*g*2 and 1*g*3), the inner pipe 210 is shielded with an insulator 260, 255, 257 at least at some points of the flow duct for gases.

Moreover, it is possible that at a point where the temperature is already low in the flow duct 115, the inner pipe is not shielded at all; not with an insulator nor with an outer pipe. Such points are typically found in the vicinity of the heat recovery surfaces, such as the walls 112, 114. Even in this case, the inner pipe 210 is shielded over almost its entire length in the flow duct 115 for gases. Consequently, in some embodiments (A)

the inner pipe 210 of the first section 202 of said heat exchanger pipe is, in some parts, insulated from the flow duct 115 for gases by means of said outer pipe 220 and/or an insulator 260, and the inner pipe 210 of the first section 202 of said heat exchanger pipe is noninsulated from the flow duct 115 for gases in one or more noninsulated areas 270 (FIG. 1*i*) in such a way that (A1)

the length of even the largest noninsulated area 270 of the first section 202 does not exceed 15 cm; preferably, the length of even the largest noninsulated area 270 does not exceed 10 cm, the length being measured in the longitudinal direction of the inner pipe 210; or (A2)

the distance from all the noninsulated areas 270 of the first section 202 to the other heat recovery surfaces of the thermal device (other than the heat exchanger pipe 200 itself) is not greater than 15 cm; preferably not greater than 10 cm; or (B)

the first section 202 of said heat exchanger pipe, or the inner pipe 210 of said first section 202, is, over its entire length, insulated from the flow duct 115 for gases by means of said outer pipe 220 and/or an insulator 260 (FIGS. 1*a* to 1*f*).

Figure 1E:
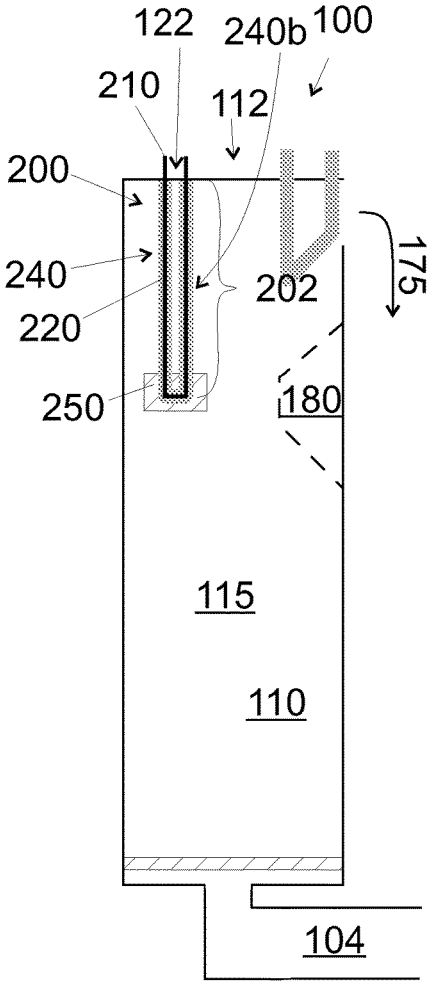
FIG. 1*e* shows a thermal device in a side view.
Figure 1F:
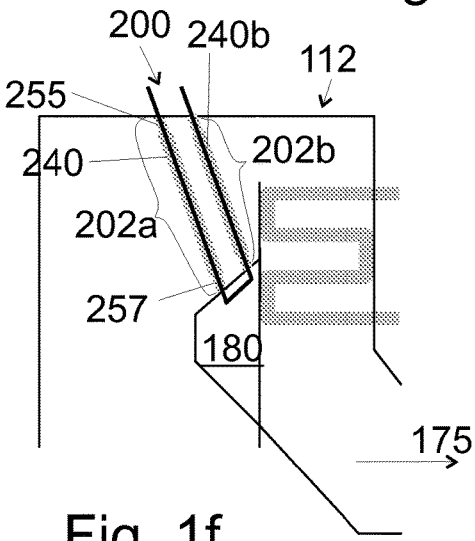
FIG. 1*f* shows a thermal device in a side view.
Figure 1I:
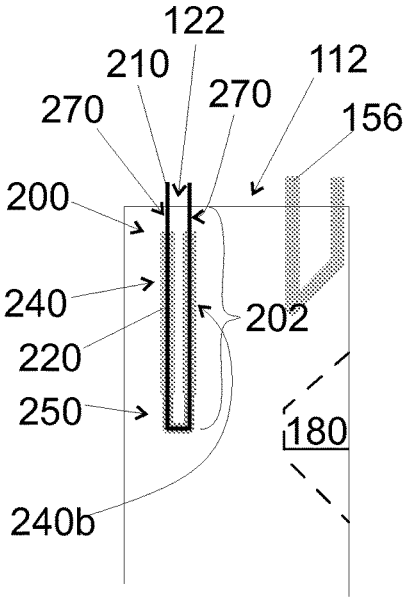
FIG. 1*i* shows a thermal device in a side view.

With reference to points (A, A1 and A2) and FIG. 1*i*, the first section 202 preferably comprises not more than two such noninsulated areas 270 (one at each end), and all the noninsulated areas 270 (the only one or both ones) extend from the wall (112, 114) of the thermal device 110 to the flow duct 115.

Point (A2) is also a possible solution, because the temperature of the gases in the flow duct 115 is typically lower in the vicinity of the heat recovery surfaces than far away from the other heat recovery surfaces. In the vicinity of the heat recovery surface, the heat exchanger pipe may also extend in the direction of the heat recovery surface or substantially in parallel with the heat recovery surface in the flow duct 115. Typically, the heat exchanger pipe extends in a direction substantially perpendicular to the wall (FIG. 1*i*).

Yet more advantageously, the first section does not comprise any non-insulated areas 270 (FIGS. 1*a* to 1*f*), wherein the inner pipe 210 is shielded over its entire length in the flow duct 115 for gases (see point B above).

An embodiment of the present invention is illustrated in FIG. 1*a*. The thermal device 100 of FIG. 1, such as a boiler, comprises a first wall 112 (a wall in the figure) comprising the first area 122 of the wall of the boiler, a second wall 114 (a wall in the figure) comprising the second area 124 of the wall of the boiler, and a reaction area 110 for generating gases, such as (a) a furnace 110 for burning material and for forming flue gases, or (b) a gasification phase for oxidizing raw material and for forming synthesis gas, wherein at least said first wall 112 of the thermal device delimits the flow duct 115 for gases in such a way that a section of the flow duct 115 for gases is left between the first area 122 of the wall of the device 100 and the second area 124 of the wall of the device 100.

In the device according to FIG. 1*a*, said flow duct 115 for gases has a rectangular cross section, wherein the thermal device 100 comprises four walls. The invention can also be applied in such thermal devices in which the flow duct for gases has a circular cross section. Such a thermal device 100 comprises the first wall 112 only. Furthermore, if the heat exchanger pipe 200 extends through the duct 115, the first wall 112 of the device also comprises the second area 124 of the wall, to which the heat exchanger pipe 200 (at least its inner pipe 210) extends. In general, the thermal device thus comprises the second wall 114 only optionally. Advantageously, the thermal device comprises at least four walls delimiting the flow duct 115 for gases. In the embodiment of FIG. 1*a*, the thermal device 100 comprises the second area 124 of the wall, comprised in said second wall 114.

FIG. 1*a* also shows a feeding duct 104 for feed gas. Combustion air can be supplied into boilers via the feeding duct 104. Gasification plants, for example, can be supplied with oxygen and/or water vapour for gasifying the raw material. In a boiler, for example, combustion air is supplied via a duct 104 and a grate 102 into a furnace 110. Advantageously, the type of the boiler 100 is a fluidized bed boiler, such as a bubbling fluidized bed boiler or a circulating fluidized bed boiler, preferably a bubbling fluidized bed boiler. In the fluidized bed boiler, such as a bubbling fluidized bed boiler, the combustion air is used to bring the solid material and the combustible material in the furnace 110 into a fluidized state; in other words, a fluidized bed is formed.

Further with reference to FIG. 1*a*, heat can be recovered in the boiler 100 by primary superheaters 152 placed in a smoke passage 160 downstream of the furnace. Heat can be recovered by superheaters 154 at the top 150 of the furnace. Heat can be recovered, for example, by tertiary superheaters 156 at the top 150 of the furnace. Conveying the flue gases to the next heat recovery surfaces, to removal, to purification, or to after-treatment is illustrated with an arrow 175. The boiler 100 may also comprise a nose 180 for guiding the flue gases and for shielding the tertiary superheaters 156 from direct radiation heat, for example. In FIG. 1*a*, the nose 180 is drawn with broken lines to illustrate that the boiler 100 does not necessarily comprise the nose 180. In FIG. 1*a*, the superheaters are arranged in the following order in the flow direction of the flue gases: secondary superheater 154, tertiary superheater 156, and primary superheater 152. The heat transfer medium (such as water and/or steam) is arranged to flow (and flows during the operation) from the primary superheater 152 to the secondary superheater 154 and further to the tertiary superheater 156.

In FIG. 1*a*, the boiler also comprises a heat exchanger pipe 200 that is particularly suitable for this purpose, as described above. The first section 202 of the heat exchanger pipe is provided in the flow duct 115 for gases. In the case of FIG. 1*a*, the first section 202 of the heat exchanger pipe consists of the above described second section 240 of the heat exchanger pipe, whose structure is illustrated in FIG. 1*g*1. In other words, the second structure 240 with the layered structure also extends over the entire length of the flue gas duct 115.

In an embodiment, the second section 240 of the heat exchanger pipe extends in a straight line or bends less than 90 degrees, as described above. Advantageously, the second section 240 bends less than 45 degrees, less than 30 degrees, or less than 15 degrees.

In a corresponding manner, in some other embodiments, the second section 240 of the heat exchanger pipe bends at least 90 degrees, at least 45 degrees, at least 30 degrees, or at least 15 degrees.

With reference to FIGS. 1*h*1 to 1*h*3, the phrase "bends less than α degrees" means that said heat exchanger pipe 200 extends in such a way that the second section 240 extends in the flow duct 115, and said second section 240 of the heat exchanger pipe has a first longitudinal direction S1 at its first point p1 (FIGS. 1*h*1 to 1*h*3), and said second section 240 of the heat exchanger pipe has, at all its points p2, a longitudinal direction S2 which is parallel to or forms an angle with a magnitude smaller than said a degrees to the first direction S1 of the second section of said heat exchanger pipe.

In this context, the longitudinal direction of the heat exchanger pipe refers to the longitudinal direction in the flow direction of the heat transfer medium. For example in FIG. 1*h*1, the direction S2 of the heat exchanger pipe is parallel with the direction S1 irrespective of the selection of the points p1 and p2. Consequently, in FIG. 1*h*1, the second section 240 of the heat exchanger pipe extends in a straight line.

Figure 2:
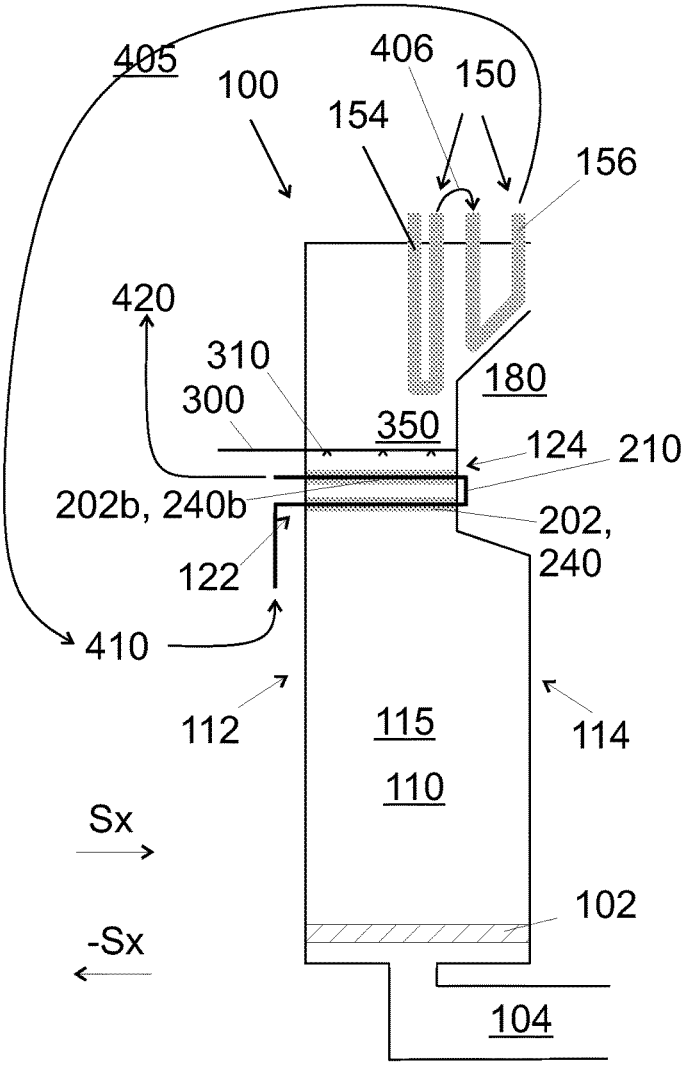
FIG. 2 shows a thermal device in a side view.

For example in FIG. 1*h*2, the direction S2 of the heat exchanger pipe deviates from the direction S1, for a certain selection of points p1 and p2, but the directions are parallel for some other selections. However, irrespective of the selection of the points p1 and p2, the angle α left between the directions S2 and S1 is smaller than 90 degrees. Consequently, in FIG. 1*h*2, the second section 240 of the heat exchanger pipe bends less than 90 degrees.

For example in FIG. 1*h*3, the direction S2 of the heat exchanger pipe deviates from the direction S1, for a certain selection of points p1 and p2. For the selection shown in the figure, the directions S2 and S2 are opposite, so that the angle α is 180 degrees. Consequently, in FIG. 1*h*3, the second section 240 of the pipe bends more than 90 degrees.

In the embodiment of FIG. 1*a*, said heat exchanger pipe 200 extends so that the second section 240 of the heat exchanger pipe extends from said first area 122 of the wall of the device to said second area 124 of the wall of the device in such a way that said second section 240 of the heat exchanger pipe has a central axis having a radius of curvature that indicates, at each point, the direction, or the change in the direction, of the central axis and is at least 25 cm, at least 50 cm, at least 1 m, at least 5 m, and most advantageously at least 10 m.

Thanks to the large radius of curvature, a medium layer 230 is also provided at each point between the outer pipe 220 and the inner pipe 210 when the pipe with a layered structure is bent. Furthermore, such a relatively straight pipe is easier to make self-supporting.

As presented above, with some technical solutions it is possible to arrange the inner pipe 210 inside the outer pipe 220, also when the outer and inner pipes are bent, in such a way that a medium layer sufficient for the heat insulation is left between these pipes.

Consequently, in an embodiment said heat exchanger pipe 200 extends so that the second section 240 of the heat exchanger pipe extends from said first area 122 of the wall of the device to said second area 124 of the wall of the device in such a way that said second section 240 of the heat exchanger pipe has a central axis having a radius of curvature that indicates, at each point, the direction, or the change in the direction, of the central axis, and being shorter than 10 m, shorter than 5 m, shorter than 1 m, shorter than 50 cm, or shorter than 25 cm.

In an embodiment, the first area 122 of the wall (such as a wall) of the device is placed on the opposite side of the flow duct 115, with respect to the second area 124 of the wall of the device. In an embodiment, the first wall 112 of the device is opposite to the second wall 114 of the boiler.

In an embodiment, the first area 122 of the wall of the boiler and the second area 124 of the wall of the boiler are parallel to each other, or the angle between the planes parallel to the areas is smaller than 45 degrees, such as smaller than 30 degrees or smaller than 15 degrees. The areas of the walls can also be perpendicular, for example if the first section of the heat exchanger pipe extends between two walls at an angle to each other.

The extension of the second section 240 of the pipe in the flow duct 115 can be represented by one or more of the following:

by the curvature of the second section 240, particularly the angle of curvature (angle α), and by the radius of curvature of the central axis of the second section 240.

For example, the second section 240 can curve not more than 45 degrees so that the radius of curvature is at least 1 m. In a corresponding manner, the second section 240 can curve more than 45 degrees so that the radius of curvature is shorter than 1 m.

In an advantageous embodiment, as illustrated in FIGS. 1*a* and 2, the section 240 of the heat exchanger pipe extends straight from said first area 122 of the wall of the boiler to said second area 124 of the wall of the boiler.

In this embodiment, the section 240 of the heat exchanger pipe has, at all points thereof, a longitudinal direction that is parallel with the first longitudinal direction of said heat exchanger pipe. As presented above, the heat exchanger pipe 200 can bend in the flow duct 215, for example, less than 90 degrees, or according to the radius of curvature, but bending is not technically advantageous in view of the manufacture. In view of the manufacture, it is technically advantageous that the inner pipe 210 can be inserted through the outer pipe 220 in its longitudinal direction. This is possible, for example, when the outer pipe 220 is straight.

As presented above and in FIG. 1*a*, the first section 202 can consist of the second section 240. With reference to FIG. 1*b*, the first section 202 of the heat exchanger pipe does not necessarily consist of the second section of the heat exchanger pipe. In the embodiment of FIG. 1*b*, the thermal device 100 comprises insulator 255 adjacent to the first wall 112 and extending from said first area 122 of the wall of the device to the flow duct 115 for gases, said insulator 255 adjacent to the first wall 112 is arranged to insulate at least the inner pipe 210 of the heat exchanger pipe 200 from the flow duct 115 for gases, the thermal device 100 comprises insulator 257 adjacent to the second wall 114 and extending from said second area 124 of the wall of the device to the flow duct 115 for gases, said insulator 257 adjacent to the second wall is arranged to insulate at least the inner pipe 210 of the heat exchanger pipe from the flow duct 115 for gases, and said second section 240 of the heat exchanger pipe extends from said insulator 255 adjacent to the first wall of the device to said insulator 257 adjacent to the second wall of the device.

Such an insulated structure is illustrated in FIG. 1*g*2, in which the inner pipe 210 is only insulated by the insulator 255, 257 adjacent to the (first or second) wall.

It is obvious that the insulator can be alternatively used in connection with only one wall, for example the first wall (not shown in the figure). Thus, the thermal device 100 comprises insulator 255 adjacent to the wall and extending from said first area 122 of the wall of the device to the flow duct 115 for gases, said insulator 255 adjacent to the wall is arranged to insulate at least the inner pipe 210 of the heat exchanger pipe from the flow duct 115 for gases, and said second section 240 of the heat exchanger pipe extends from said insulator 255 adjacent to the wall to said second area 124 of the wall of the device.

Alternatively, it is possible, for example, that the thermal device 100 comprises insulator 255 adjacent to the wall and extending from said first area 122 of the wall of the device to the flow duct 115 for gases, said insulator 255 adjacent to the wall is arranged to insulate at least the inner pipe 210 of the heat exchanger pipe from the flow duct 115 for gases, the inner pipe of the first section of said heat exchanger pipe is non-insulated from the flow duct for gases in one noninsulated area 270 in such a way that said noninsulated area 270 extends from the second area 124 of the wall of the device to the flow duct 115 for gases, and said second section 240 of the heat exchanger pipe extends from said insulator 255 adjacent to the wall of the device to said noninsulated area 270.

The length of the noninsulated area 270 is advantageously short, as presented above.

With reference to FIG. 1*c*, it is possible that the heat exchanger pipe comprises a bend, or a fold, possibly even an abrupt bend. As presented above, in such a bend it is, however, very difficult to secure the local heat conductivity of the pipe with a layered structure, because the thickness of the medium layer 230 (FIGS. 1*g*1 and 1*g*4) is difficult to control. Thus, as shown in FIG. 1*c*, the heat exchanger pipe comprises a first second section 240 and a second section 240*b*. These second sections 240 and 240*b* are represented by the above-presented features relating to the second section, such as straightness and layered structure.

Thus, the heat exchanger pipe comprises a thermally insulated section 250, in which section 250 the first section 202 of the pipe can bend even abruptly. In the thermally insulated section 250, the insulator 260 (FIGS. 1*g*3 and 1*g*4) can insulate merely the inner pipe 210 from the flow duct 115 for gases, as shown in FIG. 1*g*3, or the thermal insulator 260 can insulate the outer pipe 220 from the flow duct 115 for gases, as shown in FIG. 1*g*4. In these embodiments, said first section 202 of the heat exchanger pipe comprises a thermally insulated section 250 in said flow duct 115 for gases, in which thermally insulated section 250 the inner pipe 210 is not enclosed by the outer pipe, and the inner pipe 210 in said thermally insulated section 250 is thermally insulated by means of a thermal insulator 260 from the gases of the flow duct 115, as shown in FIG. 1*g*3, or the inner pipe 210 is enclosed by the outer pipe 220, and the outer pipe 220 in said thermally insulated section 250 is thermally insulated by means of the thermal insulator 260 from the gases of the flow duct 115, as shown in FIG. 1*g*4.

For example ceramics, mortar, or putty can be used as the insulator 255, 257 adjacent to the wall and/or as the insulator 260 in the thermally insulating area 250. The thermal conductivity κ of the insulator (255, 257, 260) is advantageously lower than 75 W/mK (Watts per meter and Kelvin), more advantageously lower than 50 W/mK, or even more advantageously lower than 10 W/mK, the thermal conductivities being given at room temperature 20° C. For example mortar can be used as the insulator. For example in this case the thermal conductivity of the insulator (255, 257, 260) can be lower than 2.5 W/mK. The thermal conductivity of e.g. some ceramics is some dozens of W/mK, for example 60 W/mK for silicon carbide (SiC), 32 W/mK for aluminium oxide ($Al_2O_3$), and 20 W/mK for silicon nitride ($Si_3N_4$). The thickness t of the insulator (255, 257, 260) is advantageously at least 0.5 mm, more advantageously at least 1 mm, and even more advantageously at least 2 mm. If necessary, the ceramic coating can be thin. Preferably, the coating is thicker when mortar or putty is used. Thus, the outer surface of the heat exchanger pipe can be equipped with protrusions, such as pins, to keep the insulator in place. This can be done particularly when fastening the insulator 255, 257 adjacent to the wall. In this case, the thickness of the insulator can be, for example, 10 to 30 mm. In an embodiment, the insulator 255, 257 adjacent to the wall is fastened to the heat exchanger pipe (outer pipe or inner pipe) by means of protrusions.

The insulator 255, 257, 260, for example gunning or ceramics, can be selected so that the insulator 260 is heat resistant and it provides the desired heat transfer level from the flow duct 115 to the heat exchanger pipe 200. The desired heat transfer level may depend on e.g. the location of the heat exchanger pipe. For example, the thickness and the thermal conductivity can be selected so that the ability to conduct heat (i.e. conductance) of the insulation layer, as determined by the thermal conductivity κ and the thickness t by the formula κ/t, is not higher than 80,000 $W/m^2K$, more advantageously not higher than 30,000 $W/m^2K$, where the thermal conductivity κ is given at room temperature 20° C. Furthermore, the insulator (255, 257, 260) should withstand temperatures corresponding to the operating temperature. Advantageously, the insulator (255, 257, 260) withstands temperatures higher than 900° C., such as higher than 1000° C., without melting or burning; optionally, the insulator does not have to withstand temperatures higher than 1500° C.

With reference to FIG. 1*d*, in an embodiment comprising a thermally insulating area 250, the heat exchanger pipe is insulated in said area by both insulation material and a shield 252. The insulation material may be mortar or putty, as described above. Furthermore, the shield 252 may be, for example, a heat resistant piece that is at least partly open at the top, such as a trough or a box. The piece that is at least partly open at the top may be, for example, a metal trough or box. The bending section of the heat exchanger pipe 200 can be provided inside said piece 252, and the mortar or putty can be cast in the box, wherein the mortar or putty will act as the insulator 260. Such a configuration is easy to implement, and furthermore, the piece 252 that is open at the top will shield the insulation material 260 left between the heat exchanger pipe 200 and the piece 252.

Advantageously, in such a bending insulating area 250, the heat exchanger pipe 200 does not comprise an outer pipe 220. This is due to the fact that the heat exchanger pipe is normally made of a straight pipe by bending. During the bending, damage, such as microfractures, takes place particularly at the bending point. If no outer pipe 220 is used at the point to be bent, the condition of the bent point of the inner pipe 210 after the bending can be secured more easily than the condition of a structure in which the inner pipe 210 would enclosed by the outer pipe 220.

As can be seen from FIGS. 1*a* to 1*c*, in these embodiments, at least the inner pipe 210 extends from said first area 122 of the wall to the outside of the flow duct 115 for gases, and at least the inner pipe 210 extends from said second area 124 of the wall to the outside of the flow duct 115 for gases.

According to FIGS. 1*a* to 1*f*, at least a section of the heat exchanger pipe 200, particularly the second section 240, is arranged in the flow duct 155 for gases delimited by the walls 112, 114, and thereby at least a section of said heat exchanger pipe, particularly its second section 240, is arranged at a distance from the walls 112, 114. Such a distance can be, for example, greater than 15 cm, such as greater than 50 cm or greater than 1 m. Consequently, the "heat exchanger pipe 200" does not refer to a heat exchanger pipe possibly extending on the wall 112, 114. A burner typically comprises several heat exchanger pipes of the above described kind, and/or their sections, which constitute a heat exchanger, such as a superheater. However, the heat exchanger is not necessarily a separate unit placed in the flow duct 115, because the inner pipe 210 may also extend outside the flow duct 115, thanks to through holes placed in the areas 122 and 124 of the wall (or walls). If the areas 122 and 124 are opposite or angular to each other, the distance between the areas 122 and 124 can be, for example, at least 0.5 m, such as at least 1 m, typically at least 2 m or at least 3 m. In the embodiments according to FIGS. 1*a* to 1*c*, the distance between the areas 122 and 124 can be, for example, 1 m to 10 m, advantageously 3 m to 6 m. A short distance will secure sufficient stability of the structure; on the other hand, a long distance will secure a sufficient heat recovery capacity. In these embodiments, the length of the second section 240 can also be, for example 1 to 10 m, advantageously 3 to 6 m, as described above. In these embodiments, the first section 202 of the heat exchanger pipe is subjected to significant shear forces, because the pipes extend substantially perpendicular to the force of gravity.

Yet some embodiments are shown in FIGS. 1*d* and 1*e*. In these embodiments, the first section 202 of the heat exchanger pipe bends 180 degrees, but the bend is, as shown in FIG. 1*c*, shielded with an insulator 260; in other words, the first section 202 of the heat exchanger pipe comprises a thermally insulated section 250 in said flow duct 115 for gases. Said thermally insulated section 250 divides said first section 202 into two second sections: the first second section 240 and the second section 240*b*. In FIGS. 1*d* and 1*e*, the first wall of the device is the top of the device.

In the embodiment of FIG. 1*d*, said first wall 112 comprises the first area 122 of the wall of the device, and the thermal device 100 comprises insulator 255 adjacent to the wall and extending from said first area 122 of the wall of the device to the flow duct 115 for gases, said second section 240 of the heat exchanger pipe extends from said insulator 255 adjacent to the wall of the device to said thermally insulated section 250, and said insulator 255 adjacent to the wall is arranged to insulate at least the inner pipe 210 of the heat exchanger pipe from the flow duct 115, In the embodiment of FIG. 1*e*, in turn, said first wall 112 comprises a first area 122 of the wall of the device, and said second section 240 of the heat exchanger pipe extends from said first area 122 of the wall of the device to said thermally insulated section 250.

In FIG. 1*f*, the heat exchanger pipe 200 comprises two first sections: a first first section 202*a* and a second first section 202*b*. Each first section 202*a*, 202*b* comprises a second section; for example, the first first section 202*a* comprises a first second section 240, and the second first section 202*b* comprises a second second section 240*b*. In FIG. 1*f*, the top of the structure acts as the first wall 112. The thermal device comprises a nose, and each first section 202*a*, 202*b* extends from the wall 112 to the nose 180. Each first section 202*a*, 202*b* comprises, at each end, an insulator 255, 257 adjacent to the wall. The second sections 240 and 240*b* extend between the insulators. The insulator 257 extends from the nose 180 to the flow duct for gases. The nose 180 constitutes a second wall 114.

In the embodiments according to FIGS. 1*d* to 1*f*, the length of the second section 240 can also be clearly longer than that described above. For example, the length of the second section can be 1 to 25 m, advantageously 3 to 15 m. In these embodiments, the first section 202, 202*a*, 202*b* of the heat exchanger pipe is not subjected to significant shear forces, because the ducts extend at a small angle to the force of gravity.

Preferably, and as shown in FIGS. 1*a*, 1*e* and 2, said second section 240, 240*b* of the heat exchanger pipe extends from said first area of the wall of the device to said flow duct for gases. This gives the advantage that at least the section of the heat exchanger pipe adjacent to the wall is insulated by at least the outer pipe from the flow duct for gases. The outer pipe 220 has been found to be a solution that is more durable in view of corrosion protection and more serviceable (for example replaceable) than using the insulator 255. In addition, the structure can thus be made mechanically even more stable by connecting the outer pipe to the wall, for example by welding.

Such a structure has some technical advantages.

Firstly, the medium layer 230 insulates the inner pipe 210 thermally from the outer pipe 220. Thus, there is little transfer of heat from the outside to the inner pipe 210 and further to the heat transfer medium. As a result, heat losses in such a duct take place mostly in the medium layer 230 and not in the inner pipe 210.

Consequently, even if the heat exchanger pipe 200 is placed in an environment (duct 115) in which a very high temperature prevails, wherein the surface temperature of the heat exchanger pipe 200 rises high, the temperature of the inner pipe 210 does not become too high in view of the regulations for designing the material of the inner pipe. In a corresponding manner, if the temperature of the inner surface of the inner pipe 210 is to be raised in order to form a hotter heat transfer medium, the layered structure according to FIG. 1*g*1 can be used, particularly by adjusting the thickness of the medium layer 230, to secure that the temperature of the outer surface of the inner pipe 210 does not become too high in view of the durability of the material. Because the inner pipe 210 contains heat transfer medium under pressure during the use, the inner pipe 210 should withstand the respective pressure. It is known that materials are less capable of withstanding pressure at a high temperature than at a low temperature. Said "too high" temperature refers to the temperature at which the inner pipe 210 is no longer capable of withstanding the pressure prevailing in it. In a corresponding manner, the medium layer 230 does not need to withstand pressure, because the pressure is taken by the inner pipe 210. Moreover, the outer pipe 220 does not need to withstand pressure. In the flow duct for gases, the first section 202 of said heat exchanger pipe, or the inner pipe 210 of the first section 202 of said heat exchanger pipe is, over its entire length or almost its entire length, insulated from the flow duct for gases by means of said outer pipe and/or an insulator, as presented above. In this way, it is prevented that the temperature of the inner pipe would become too high in view of the prevailing pressure level locally, for example at a noninsulated point. Furthermore, condensing of a corrosive substance on the outer surface of the inner pipe is avoided. The solution may comprise noninsulated areas 270 as presented above (FIG. 1*i*). Preferably, however, such areas are only present in the vicinity of other heat recovery surfaces, such as the wall 112, 114. This has been described in more detail above. Advantageously, the distance from all the points of the noninsulated areas 270 to the heat recovery surfaces of the thermal device (excluding the heat exchanger pipe 200 itself) is not greater than 15 cm, more advantageously not greater than 10 cm. At such a point, the temperature of the gases in the flow duct 115 is typically clearly lower than in the centre of the flow duct.

Secondly, the outer pipe 220 shields the structures inside it, that is, the medium layer 230 and the inner pipe 210, from corrosion and mechanical wear. The outer pipe 220 is advantageously a single piece, wherein the outer pipe effectively shields the medium layer 230 and the inner pipe 210 from mechanical wear. Such a single-piece outer pipe 220 is, for example, weldless. In addition or alternatively, such a single-piece outer pipe 220 is, for example, without holes. Moreover, the outer pipe 220 can shield the insulation layer 230 and the inner pipe 210 over at least the whole length of the flow duct 115 for gases. Consequently, the second section 240 of the duct advantageously comprises a single-piece outer pipe 220 extending over its entire length. Yet more advantageously, such a second section extends over the entire length of the first section 202.

Thirdly, because the surface temperature of the outer pipe 220 is high, as described above, no corrosive substances, such as salts, will condense on its surface. The same also applies to the insulated area 250. Salts condense from flue gases onto heat recovery services when the partial pressures of steam in the flue gas exceeds the pressure of saturated steam. The pressure of saturated steam, in turn, is significantly dependent on the temperature. In a combustion process, salts in steam phase are formed in flue gases in such amounts that condensing takes place, typically for example when the temperature of the heat recovery surface is lower than 500° C., lower than 550° C., or lower than 600° C. In a corresponding manner, condensing does not take place if the surface temperature of the heat recovery surface is higher. Advantageously, during the operation, the temperature of the outer surface of the outer pipe 220 of the heat exchanger pipe 200 is at least 550° C., at least 600° C., or at least 650° C., such as about 670° C. or higher. In a use of the thermal device, the heat transfer medium is allowed to flow in said inner pipe in such a way that the temperature of the outer surface of the outer pipe is higher than 600° C. Furthermore, steam is advantageously used as the heat transfer medium.

As for other noninsulated areas 270 in the vicinity of the heat recovery surfaces, it is noted that at lower temperatures, the corrosion problem is reduced for the above described reasons.

Fourthly, the structure makes it possible to use fuels having a higher content of heavy metals or chlorine than usual. As presented above, the temperature of the outer surface of the outer pipe 220 rises high because of the insulation layer 230. Thus, the condensing of heavy metals and/or chlorides (e.g. NaCl, KCl) on the outer surface of the outer pipe 220 is prevented or at least reduced to a very significant extent. Consequently, the boiler 100 can be used even for long times without maintenance even if the contents of heavy metals and/or chlorides in the flue gases were higher than in the flue gases of boilers of prior art. Further, this enables the application of said fuels in the boiler.

Fifthly, even though the presented layered structure of the heat exchanger pipe 200 increases the mass of the heat exchanger pipe 200, the presented structure will carry the mass of the heat exchanger pipe 200, because the second section 240 of the heat exchanger pipe extends in the flow duct 115 for flue gases approximately in the same direction over its whole length, or it does not have abrupt bends, as described above in more detail. If the second section 240 of the pipe twisted in the flow duct 115 for flue gases, the second section 240 of the heat exchanger pipe would subject its supporting structures to a relatively high torque, or the flow duct 115 should be fitted with separate supporting structures. Due to this supporting, the length of the second section 240 is advantageously relatively short, at least when the second section is horizontal, as will be presented further below.

Advantageously, the ducts 210, 220 have a circular cross section. Pipes of this kind are technically easy to manufacture, and furthermore, they are more resistant to pressure than pipes of other shapes.

The inner diameter of the inner pipe 210 can be, for example, 30 to 60 mm, such as 40 to 50 mm, advantageously about 45 mm, such as 42 to 46 mm. The thickness of the shell of the inner pipe can be, for example, 4.5 to 7.1 mm. The thickness of the shell refers to the thickness of the wall of the duct, that is, the half of the difference between the outer diameter and the inner diameter. The inner pipe 210 can comprise for example steel. The inner pipe 210 can comprise for example ferritic or austenitic steel. Advantageously, the inner pipe 210 comprises austenitic steel.

The thickness of the medium layer 230 is advantageously 0.5 to 4 mm, such as 1 to 2 mm. The medium layer may comprise solid, liquid or gaseous medium. The medium layer may comprise at least one of the following: gas (such as flue gas, air, synthesis gas, pyrolysis steam), putty, and ceramics. Advantageously, the medium layer comprises putty, and the thickness of the putty layer is 1 to 2 mm. The putty can be selected, for example, so that the putty is resistant (without burning and/or melting) to temperatures higher than at least 700° C. but possibly not higher than 1000° C.

The inner diameter of the outer pipe 220 is dimensioned according to the outer diameter of the inner pipe 210 and the thickness of the medium layer 230. Because the medium layer 230 can comprise gas, increasing the inner diameter of the outer pipe 220 will increase the thickness of the insulation layer 230 if the outer diameter of the inner pipe 210 is not increased in a corresponding way. The inner diameter of the outer pipe 220 can be, for example, 35 to 70 mm. The thickness of the shell of the outer pipe 220 can be, for example, 4.5 to 7.1 mm. The outer pipe 220 can comprise for example steel. The outer pipe 220 can comprise for example ferritic or austenitic steel. Advantageously, the outer pipe 220 comprises austenitic steel.

Typically, in a thermal device, such as a boiler, the temperature depends on the location, and particularly the height in view from the furnace 110. In FIGS. 1*a* to 1*c* and in FIG. 2, said first section 202 of the heat exchanger pipe is horizontal, or the longitudinal direction of said first section forms an angle smaller than 30 degrees at its every point with the horizontal plane. The angle can also be, for example, smaller than 20 degrees, smaller than 10 degrees, or smaller than 5 degrees. The term "horizontal" refers to a line in the horizontal plane, such as a pipe curved in the horizontal plane, or a horizontal pipe. The term "every point" specifies that the longitudinal direction of the pipe depends on the point of viewing, if the pipe is not straight.

This gives the advantage that the whole outer pipe 220 of the second section 240 of the heat exchanger pipe will be substantially at the same temperature. By the placement of the second section 240 in the height direction it is possible to make sure that the whole outer pipe is at the same, sufficiently high temperature in view of condensing of corrosive substances. When the whole second section 240 of the heat exchanger pipe 200 is placed at substantially the same temperature, it is considerably easier, on one hand, to dimension the structure to enable the production of hot heat transfer medium and, on the other hand, not to exceed or go below the operating temperatures of the materials even locally, than in a situation in which the heat exchanger pipes extended for example vertically (FIGS. 1*d* and 1*e*) or in another direction (FIG. 1*f*). It should be mentioned that even if the second section 240 (or the second sections 240, 240*b*) were horizontal, that section of the pipe 200 which is outside the flow duct 115 can extend in another direction, such as the vertical direction, as shown in FIG. 2.

In an advantageous embodiment, the length of the first section 202 of the heat exchanger pipe 200 is, for example, shorter than 6 m, wherein the first section 202 of the heat exchanger pipe 200 is self-supporting in the horizontal direction as well. Self-supporting refers to a structure which is supported at its ends only. Thus, no separate supporting structures will be needed for the first section 202 of the pipe in the flow duct 115 for flue gases. The heat exchanger pipe 200, particularly the inner pipe 210, is supported to the first and second areas (122, 124), from which the inner pipe is conveyed through the wall or walls. The length of the first section 202 is advantageously not greater than 5 m and more advantageously not greater than 4.5 m. For achieving a sufficient heat transfer capacity, the length of the first section 240 is advantageously at least 1 m, such as at least 2 m, and more advantageously at least 3 m. The length of the first section 240 can be, for example, about 4 m. What has been said here about the length of the first section 202 also applies to the length of the second section 240.

Moreover, in the self-supporting structure, there is no need to support the heat exchanger pipe 200 or its sections in the flow duct 115 for flue gases. In an embodiment, the first section 202 of the heat exchanger pipe extends freely in the flow duct 115. Thus, the first section 202 of the heat exchanger pipe is not supported to the rest of the structure, such as the wall (112, 114) of the thermal device 100, the top of the thermal device 100, another heat exchanger pipe 200, another first section 202*b* of the same heat exchanger pipe 200, or another second section 240*b* of the same heat exchanger pipe 200. Such a freely extending structure is technically easier to manufacture than a supported structure. Furthermore, the freely extending structure does not involve supporting structures which would conduct heat to the heat exchanger pipe. Moreover, the presence of supporting structures would make it more difficult to design the suitable operating temperature and to maintain the thermal device.

With the presented solution, it is possible to raise the outer temperature of the outer pipe 220 of the heat exchanger pipe 200 so high that no corrosive substances condense on its surface, such as heavy metals and/or alkali salts, particularly sodium chloride (NaCl) or potassium chloride (KCl). During the operation, the temperature of the outer surface of the pipe 200 is advantageously high, as described above. In a corresponding manner, during the operation, the temperature of the heat transfer medium, such as steam, flowing inside the inner pipe 210, is, for example, at least 500° C., such as at least 530° C., and advantageously at least 540° C. In a use of the thermal device, the heat transfer medium is allowed to flow in said inner pipe 210, steam is used as the heat transfer medium, and the temperature of the heat transfer medium flowing in the inner pipe 210 is at least 500° C., preferably at least 530° C.

In such use, the temperature of the inner pipe 210 is, for example, between 500° C. and 700° C. and advantageously between 500° C. and 600° C.

To achieve these values, some measurements have been presented above. Furthermore, in an embodiment of the thermal device 100, the heat exchanger pipe according to the invention is placed in such a way with respect to the other heat exchanger pipes and flow directions that said temperature values are fulfilled. In some embodiments, said first section of the heat exchanger pipe is placed in a desired temperature zone in the thermal device 100, by selecting a desired height position for said first section 202 of the pipe in the thermal device 100, such as a boiler.

FIG. 2 shows an advantageous way of selecting said desired height position and placing the first section 202 of the heat exchanger pipe. In this embodiment, the thermal device 100 comprises several other heat transfer pipes, such as superheaters 154 and 156, inside the walls of the flow duct 115 for gases for recovering heat, said heat exchanger pipe 200 and said other heat transfer pipes (154, 156) constitute a continuous flow duct for the heat transfer medium, for heating the heat transfer medium, and said flow duct for the heat transfer medium comprises, as its last heat transfer element placed in the flow duct 115 for gases in the flow direction of the heat transfer medium, a first section 202*b* of said heat transfer pipe 200. Because the different first sections can be named as desired, such a first section can be said first section 202 (not shown in the Figure).

For example in FIG. 2, the flow duct for heat transfer medium comprises superheaters 154 and 156 as well as a heat transfer pipe 200, e.g. its second sections 240 and 240*b*. In FIG. 2, the second sections 240 are also the first sections 202; the insulator (255, 257) adjacent to the wall is not shown. Thus, a first section (section 202*b* in the figure) of the heat exchanger pipe is exactly the last heat transfer element, such as a heat exchanger pipe or a heat transfer pipe, in said circulation, placed in the flow duct 115 for gases. From such a first section 202*b*, which in FIG. 2 comprises the second second section 240*b*, the heated heat transfer medium is conveyed via the return circulation 420 to, for example, energy production. After said first section 202, the heated heat transfer medium is not conveyed to a heat transfer element (such as a heat transfer pipe or the heat exchanger pipe) in the flow duct for gases.

Another advantageous height position is also realized in the embodiment of FIG. 1*d*. In this embodiment, the thermal device 100 comprises several other heat transfer pipes 152, 156 inside the walls of the flow duct 115 for gases, for recovering heat, said heat exchanger pipe 200 and said other heat transfer pipes 152, 156 constitute a continuous flow duct for the heat transfer medium, for heating the heat transfer medium, and said flow duct for the heat transfer medium comprises the last first section 202 of the heat exchanger pipe placed in the flow duct for gases, in the direction of flow of the heat transfer medium, and at least one heat transfer pipe (such as pipe 152 in FIG. 1*d*) placed downstream in the flow duct for gases, in the direction of flow of the heat transfer medium, and said last first section 202 of the heat exchanger pipe is arranged, in the flow direction of the gas flowing outside the outer pipe, upstream of said heat transfer pipes (pipes 152 in FIG. 1*d*) placed downstream in the flow duct for gases in the flow direction of the heat transfer medium.

For example, the flow duct for heat transfer medium shown in FIG. 1*d* comprises superheaters 152 and 156 as well as a heat exchanger pipe 200, e.g. its second sections 240 and 240*b*. In FIG. 1*d*, the first section 202 comprises the second sections 240 and 240*b*. Thus, the first section 202 shown in FIG. 1*d* is, in the flow direction of the heat transfer medium, the last first section 202 of the heat exchanger pipe placed in the flow duct for gases. Furthermore, the flow duct for the heat transfer medium comprises a heat transfer pipe 152 placed downstream of said section 202 in the flow direction of the heat transfer medium in the flow duct for gases. In FIG. 1*d*, the last first section 202 of the heat exchanger pipe, i.e. the first section 202, is arranged, in the flow direction of the gas flowing outside the outer pipe 220, upstream of said heat transfer pipes 152 in the flow direction of the heat transfer medium. The flow direction of the gases is illustrated with arrows 175. Obviously, the pipe 152 is placed downstream of the pipe 200 in the flow direction of the gases.

In such use, the noninsulated heat transfer pipe downstream of the last first section 202 of the heat exchanger pipe in said medium circulation may be placed, in the flow duct for flue gases, in an area whose temperature is, for example, below 500° C. In addition, when the temperature of the heated medium in said last first section 202 of the heat exchanger pipe is advantageously at least 500° C., no condensing takes place on the surface of the noninsulated pipe. In a use heat transfer medium is heated to a first temperature in said first section 202 of the heat exchanger pipe placed last in the flow duct for gases, in the direction of the heat transfer medium, at least one said heat transfer pipe 152 downstream in the flow direction of the heat transfer medium is arranged in an area where a second temperature is prevailing in the flow duct for gases, and the second temperature is not higher than the first temperature.

Thus, the heat exchanger pipe 200 with a layered structure, particularly the first section 202, 202*b* of the heat exchanger pipe placed last in the flow duct for gases, is arranged in a hotter place than the other heat transfer pipes. In the first section 202, 202*b* of the heat exchanger pipe placed last in the flow duct for gases, the heated heat transfer medium is, in such a solution, typically so hot that no significant condensing of corrosive substances will take place on the surface of the heat transfer pipes downstream. If the heat transfer element placed last in the flow duct 115 for gases, in the flow direction of the heat transfer medium, is a structure of the above described kind, the structure comprises no heat transfer pipes on which corrosive substances would condense downstream.

Advantageously, the heat exchanger pipe 200 is arranged close to the point of forming heat. For example in a boiler, the distance between the first section 202 of the heat exchanger pipe 200 with a layered structure, closest to the grate 102 (in the flow direction of flue gases), and the grate 102 can be, on one hand, at least 5 m or at least 10 m, to secure a sufficiently large furnace 110. On the other hand, the distance between a first section 202 of the heat exchanger pipe 200 with a layered structure and the grate 102 can be, for example, not greater than 50 m, not greater than 40 m, or not greater than 35 m, to secure the hotness of the environment of the heat exchanger pipe 200 during the operation. In a corresponding manner, the height of the first section 202 of the heat exchanger pipe 200 in the thermal device 100 above the earth's surface can be, for example, not greater than 50 m, not greater than 40 m, or not greater than 35 m. In a corresponding manner, the height of the first section 202 of the heat exchanger pipe 200 in the thermal device 100 above the earth's surface can be, for example, at least 5 m or at least 10 m.

With reference to FIG. 2, the thermal device according to an embodiment comprises means 300 for feeding an auxiliary agent, for feeding an auxiliary agent for the process, such as an auxiliary agent for the combustion process, for example to the furnace or the process area, a part of which means 300 for feeding an auxiliary agent is placed in the flow duct 115 for gases, and said part of the means 300 for feeding an auxiliary agent is placed downstream of the first section 202 or another first section 202 of said heat exchanger pipe 200 in the flow direction of gases.

This gives the advantage that the auxiliary agent is only supplied to the flue gases cooled by the heat exchanger pipe 200, whereby the effect of the auxiliary agents is improved.

The auxiliary agent is preferably liquid, for example an aqueous solution of a reacting agent. The means 300 comprise a pipe or the like for feeding the liquid auxiliary agent to the flow duct 115 for gases, and one or more nozzles 310. Advantageously, the feed means 300 extend through the flow duct 115 over its entire length in one direction, wherein auxiliary agent can be supplied over substantially the entire area of the flow duct in the direction of its cross section.

The auxiliary agent comprises at least one of the following: ammonia ($NH_3$), ammonium ion ($NH_4^+$), ferric sulphate ($Fe_2(SO_4)_3$), ferrous sulphate ($FeSO_4$), aluminium sulphate ($Al_2(SO_4)_3$) ammonium sulphate ($(NH_4)_2SO_4$), ammonium hydrogen sulphate ($(NH_4)HSO_4$), sulphuric acid ($H_2SO_4$), and sulphur (S), as well as aqueous solutions of these. Advantageously, the auxiliary agent comprises ammonia ($NH_3$) or ammonium ions ($NH_4^+$). One way of operating the boiler 100 is to use said means for feeding auxiliary agent to supply the boiler with an auxiliary agent that comprises ammonia ($NH_3$) or ammonium ions ($NH_4^+$). In a use of the thermal device, said means for feeding an auxiliary agent are used for supplying the thermal device with an auxiliary agent, the auxiliary agent comprising at least one of the following: ammonia ($NH_3$), ammonium ion ($NH_4^+$), ($Fe_2(SO_4)_3$), ($FeSO_4$), ($Al_2(SO_4)_3$), ($(NH_4)_2SO_4$), ($(NH_4)HSO_4$), ($H_2SO_4$), and sulphur (S), as well as aqueous solutions of these. In an advantageous embodiment, the auxiliary agent comprises ammonia ($NH_3$) or ammonium ions ($NH_4^+$).

Further with reference to FIG. 2, an embodiment comprises a first heat exchanger comprising said heat exchanger pipe 200 and further several heat exchanger pipes 200 which comprise some inner pipe 210, at least one outer pipe 220 and a medium layer 230 remaining between the outer pipe and a section of an inner pipe, a second heat exchanger comprising several heat transfer pipes, the first heat exchanger being arranged upstream of said second heat exchanger in the flow direction of gases, the second heat exchanger being spaced from the first heat exchanger, wherein a space 350 is left between the second heat exchanger and the first heat exchanger, part of the means 300 for feeding an auxiliary agent being placed in the flow duct 115 for gases, and said part of the means 300 for feeding an auxiliary agent being arranged in said space 350.

For example, the second heat exchanger can be arranged in the top of the process area 110 of the thermal device 100, as shown in FIG. 2. The second heat exchanger can be, for example, a conventional pipe assembly comprising several heat transfer pipes. In an embodiment shown in FIG. 2, the second heat exchanger is a secondary superheater 154.

Obviously, a part of the pipes of the means for feeding an auxiliary agent is placed outside the boiler. Furthermore, it is obvious that other means for feeding an auxiliary agent can be placed in other parts of the boiler.

With reference to FIG. 2, one embodiment of the boiler 100 comprises a first section 202 of said heat exchanger pipe, that is, the first first section 202 of the heat exchanger pipe, said heat exchanger pipe comprises a second first section 202*b* extending from one wall (the second wall 114, FIG. 2) to the same or another wall (the first wall 112, FIG. 2) in the flow duct for gases, the second first section 202*b* or the inner pipe of said second first section 202*b* being insulated over its entire length from the flow duct for gases by means of a second outer pipe and/or an insulator, and said inner pipe 210 connecting said first first section of the heat exchanger pipe to said second first section of the heat exchanger pipe outside said flow duct for gases.

In this way it is easy to guide the inner pipe 210 back to the duct 115, and a separate insulated area 150 is not necessarily needed although the first sections extend straight in the flow duct 115.

It is also possible that the second first section 202*b* is only insulated over almost its entire length from the flow duct 115, as presented earlier (see alternatives A, A1, A2, and B above). The second first section comprises at least an inner pipe which is, in the above described way, insulated, for at least the most part, from the flow duct 115 for gases. Furthermore, the second first section may, and advantageously does, comprise a second second section where an outer pipe encloses the inner pipe of the second first section.

In FIG. 2, the first first section 202 extends from the first area 122 of the wall of the device to said second area 124 of the wall of the device in the flow direction of the heat transfer medium, and the second first section 202*b* extends from said second area 124 of the wall of the device to said first area 122 of the wall of the device in the flow direction of the heat transfer medium.

As described above, the first first section 202 comprises the first second section 240. Advantageously, the second first section 202*b* also comprises a second second section 240*b*. Furthermore, it would be possible for either of the first sections 202, 202*b* to comprise several second sections, as shown in FIG. 1*c*.

Advantageously, the sections 240, 240*b* extend straight in the flue gas duct 115. In an embodiment, said first second section 240 of the heat exchanger pipe extends straight in the flow duct for gases, wherein said first second section 240 extends in a longitudinal direction Sx parallel with the flow direction of the medium flowing in the first pipe, the heat exchanger pipe comprises a second second section 240*b* extending straight in the flow duct for gases, wherein said second second section 240*b* extends in a longitudinal direction −Sx parallel with the flow direction of the medium flowing in the second pipe, the second longitudinal direction −Sx is opposite to the first longitudinal direction Sx, and said inner pipe 210 connects said first first section 202 of the heat exchanger pipe to said second first section 202*b* of the heat exchanger pipe outside said flow duct 115 for gases.

Advantageously, only the inner pipe 210 connects said first first section 202 of the heat exchanger pipe to said second first section 202*b* of the heat exchanger pipe outside said flow duct 115 for gases, because the structure will thus become simpler. It is naturally possible that also the outer pipe 220 extends outside the flow duct 115. This solution has the advantage that in this way, the heat exchanger pipe 200 or a corresponding heat exchanger can be connected to the water circulation of the device 100 in such a way that the feed and return circulations are on the same side of the boiler, in FIGS. 2 and 5*b* on the left side. The same effect can also be achieved by using an insulated and bent pipe as shown in FIGS. 1*d* and 1*e*. In these embodiments, the thermal device comprises a feed circulation 410 of heat transfer medium, for feeding heat transfer medium to the heat exchanger pipe 200, and a return circulation 420 of heat transfer medium, for returning heat transfer medium from the heat exchanger pipe 200, and the heat exchanger pipe 200 is connected to the feed circulation 410 and the return circulation 420 on the same side of the first wall 112 of the boiler.

Advantageously, the heat exchanger pipe 200 is used as the last superheater of the boiler 100. Thus, the boiler comprises means for conveying heat transfer medium from a tertiary superheater 156 to said heat exchanger pipe 200.

At this stage, superheated steam typically acts as the heat transfer medium.

If the thermal device 100 comprises two or more insulated first sections 202 of the above described kind in such a way that at least two sections (202, 202*b*) of the heat exchanger pipe are spaced in the flow direction of gases, the sections (202, 202*b*) are advantageously placed downstream in the flow duct for gases; downstream with respect to both the medium and the gases. To put it more precisely, in such a thermal device, said second first section 202*b* of the heat exchanger pipe is placed downstream of said first first section 202 of the heat exchanger pipe in the flow direction of the medium flowing in the inner pipe 210, and said second first section 202*b* of the heat exchanger pipe is placed downstream of said first first section 202 of the heat exchanger pipe in the flow direction of the gas flowing outside the heat exchanger pipe.

For example, in FIG. 2, the second first section 202*b* is placed above the first first section 202. When superheated steam passes from the inside of the first first section 202 to the inside of the second first section 202*b*, at the same time gases flow upwards, that is, from the outer surface of the first first section 202 towards the outer surface of the second first section 202*b*.

In such an arrangement, both sections 202 and 202*b* are heated more evenly with respect to each other than in an arrangement in which the sections 202, 202*b* were placed upstream relative to said flows. Said more even heating will reduce thermal stresses caused and will improve durability.

Preferably, the tertiary superheater 156 is also directed downstream, as shown in FIG. 2. The flow direction of heat transfer medium flowing from the tertiary superheater 156 is illustrated with an arrow 405. Superheated steam from the return circulation of the tertiary superheater 156 is conveyed further to the feed circulation 410 of the heat exchanger pipe 200 with a layered structure.

During the operation of the thermal device, the heat transfer medium and the flue gas flow in the above described way. At other times, the heat transfer medium and the flue gas in the boiler 100 are arranged to flow in the above described way. The flow direction from the thermal device is obvious for a person skilled in the art. The heat transfer medium flows from the input to the use, such as to power production or to the use of heat. Gases flow from the process area to the use, such as to heat recovery or discharge.

In the embodiment shown in FIG. 2, the wall of the thermal device, such as a boiler, comprises a nose 180, and said first section 202 of the heat exchanger pipe extends from said nose 180.

In FIG. 2, the nose 180 comprises the second area 124 of the wall of said device. Areas and walls can be named freely, whereby the nose could alternatively comprise said first area 122 of the wall of the boiler. Furthermore, the first wall 112 of the boiler can comprise the nose 180, or another wall of the boiler can comprise the nose 180.

When the nose 180 comprises said first 122 or second 124 area of the wall of the device, the span of the first section 202 (or 202*b*) of the heat exchanger pipe 200 becomes shorter, because the nose 180 extends from the wall of the boiler towards the flow duct 115 for gases. In this way, the nose forms a protrusion in the wall, extending into the flow duct for gases. The nose makes the flow duct for gases narrower. The shorter span stabilizes the structure of the heat exchanger pipes 200. Above, advantageous lengths were presented for the first section 202 and the second section 240 of the heat exchanger pipe 200, the length corresponding to said span.

Figure 3A:
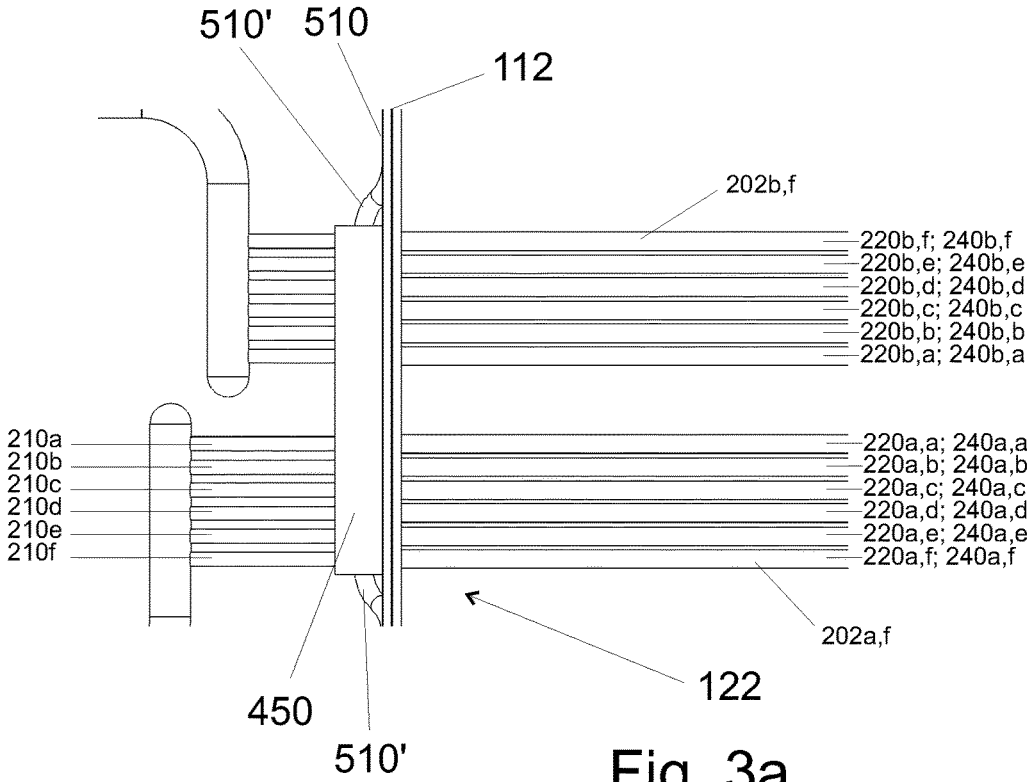
FIG. 3*a* shows a more detailed view of the first section of a wall of a thermal device seen from the side.

FIG. 3*a* shows a way of connecting the heat exchanger pipe 200 to the first wall 112 of the thermal device 100 in the first area 122 of the wall. A corresponding connection can be provided in the second area 124 of the wall. FIG. 3*a* shows the first area 122 of the wall, and its vicinity, in a side view.

The wall 112 of the boiler shown in FIG. 3*a* comprises heat transfer pipes 510 for recovering heat. In the first area 122, inner pipes 210*a* to 210*f* are introduced through the wall and arranged, on the side of the flow duct for flue gases, inside the outer pipes 220*a,a* to 220*a,f* and 220*b,a* to 220*b,f* in the above described way. Thus, the outer pipes belong to the first second sections 240*a,x* and the second second sections 240*b,x*, where x is a, b, c, d, e, or f. In a corresponding manner, the inner pipe 210*x* is divided into a first first section 202*a,x* and a second first section 202*b,x*. At least part of the first sections 202*a,x* and 202*b,x* are enclosed by an outer pipe 220*a,x* or 220*b,x*, respectively, in the above described way. Because the outer pipes are connected to the areas 122, 124 and the temperature of said areas is lower than the temperature in the flow duct 115, the temperature of the outer pipes 220 will increase when moving from the vicinity of the area 122, 124 to the central parts of the flow duct. This will result in a temperature gradient in the outer pipe, and said temperature gradient may impair the service life of the outer pipe 220.

Figure 3B:
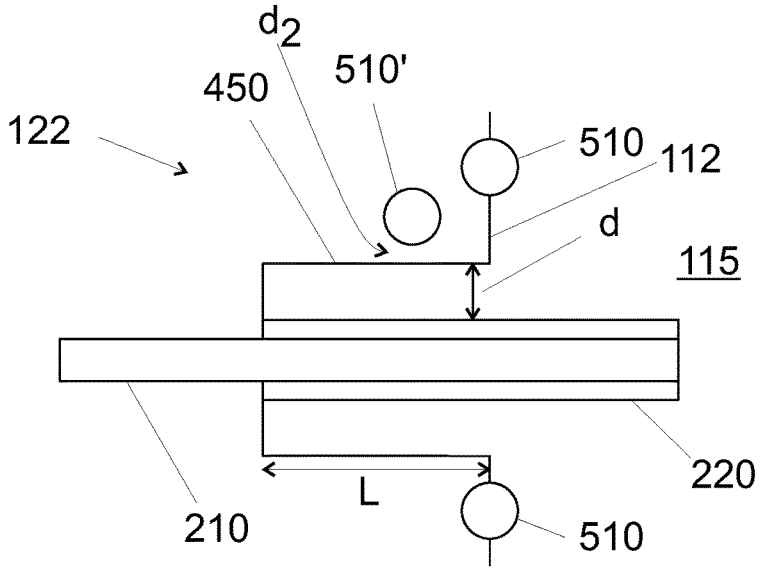
FIG. 3*b* shows a principle view of the area of a wall in FIG. 3*a* seen from above.

In the embodiment shown in FIGS. 3*a* and 3*b*, the first 122 or second 124 area of the wall of the thermal device 100 comprises a housing 450, which housing 450 protrudes from the wall of the thermal device, for example from the first 112 or second 114 wall, outwards from said flow duct 115 for gases, the housing 450 comprising a through hole for conveying said inner pipe 210, 210*a* to 210*e* out from the reaction area 110 of the thermal device 110, such as from a furnace 110 of a boiler or from the flow duct 115 for gases, and the inner surface of the housing 450 being provided with said outer pipe 220, 220*a* to 220*e* for shielding the inner pipe 210 of the heat exchanger pipe 200 and optionally the medium layer 230, insulator 255, 257 adjacent to the wall, extending from the inner surface of the housing 450 to the reaction area 110 of the thermal device or to the flow duct 115 for gases; or said noninsulated area 470 of the first section 202 (see FIG. 1*i*) extending from the inner surface of the housing 450 to the reaction area 110 of the thermal device or to the flow duct 115 for gases.

Preferably, the outer pipe 220 is tightly fastened to the inner surface of the housing 450 so that the flue gases of the flue gas duct 115 cannot contact the insulation layer 230 or the inner pipe 210. The outer pipe can be, for example, welded to the housing 450.

The housing 450 can also be applied in the embodiments shown in FIGS. 1*b* and 1*c*. Thus, the insulator 255 adjacent to the wall extends from the inner surface of the housing 450 to the flow duct 115 for gases, for shielding the inner pipe of the heat exchanger pipe.

Furthermore, as shown in FIGS. 1*i* and 3*b*, it is possible that the noninsulated area 270 of the inner pipe 210 is placed in the housing 450.

When the housing 450 protrudes from the wall of the boiler in the above described way, the flow of gases in the housing 450 is very slow compared with the flow in the flow duct 115 for gases. Thus, very little corrosive condensation takes place in the housing. Firstly, because the flow is very slow, the amount of gas from which condensation can take place, is reduced. Thus, the condensing is reduced as well. Secondly, because heat is recovered from the gases in the housing, too, the gas in the housing will cool down to a lower temperature than the gas flowing in the flow duct 115. In such colder ranges, corrosion is slow, as described above.

Furthermore, the temperature in the housing 450 increases from the edge area towards the flow duct 115. In the embodiment with the housing, the temperature of the outer pipe 220 increases over a clearly greater length of travel than in a situation in which there is no such protruding housing. The greater length of travel, in turn, means a lower temperature gradient, which increases the service life compared with an embodiment without said housing. To reduce corrosion and to sufficiently reduce the temperature gradient, the depth L of the housing (FIG. 3*b*) can be, for example, at least 10 cm, more advantageously at least 15 cm or at least 20 cm.

FIG. 3*b* shows a principle view of the situation of FIG. 3*a* seen from above. In FIG. 3*b*, a distance d is left between the inner surface of said housing 450 and the outer surface of said outer pipe 220, wherein said outer pipe 220 (and thereby also the inner pipe 210) is thermally insulated from the boiler wall. The distance d can be, for example, at least 1 mm, at least 5 mm, or at least 10 mm. As presented above, the inner pipe 210 in the housing can, in some embodiments, be insulated by means of an insulator 255, 257 adjacent to the wall (FIGS. 1*b*, 1*c*). In this embodiment, a distance d is advantageously left between the inner surface of the housing 450 and the outer surface of said insulator 255, 257, wherein said insulator is also thermally insulated from the housing. Also in this case, the distance d can be, for example, at least 1 mm, at least 5 mm, or at least 10 mm. Furthermore, in an embodiment in which part of the inner pipe is noninsulated, a distance d is left between the inner surface of said housing 450 and the noninsulated area 470. Thus, the inner pipe 210 is thermally insulated from the wall of the thermal device. Such a distance will further thermally insulate the heat exchanger pipe 200 from the wall (112, 114) of the boiler and increase the expected service life, i.e. the probable service life, of the heat exchanger pipe 200. Such a distance will thermally insulate the heat exchanger pipe 200 from the wall (112, 114) of the boiler, because a thermally insulating medium is thus left between the heat exchanger pipe 200 and the boiler wall (112, 114). As will be presented further below, the distance d is not necessarily constant, if, for example, the inner surface of the housing 450 is curved. The distance d refers to the shortest distance from the outer surface of the outer pipe 220 or the insulator 260 to the line segment formed as the housing 450 coincides with that wall of the boiler, from which the housing 450 protrudes (e.g. the first wall 112, see FIGS. 4*a* and 4*b*). Put more broadly, the distance d is the distance between the outer surface and the wall 112 of the device 100 at the end of the housing 450 on the side of the flow duct 115.

Advantageously, at least one of the walls of the housing 450 does not comprise the heat exchanger pipe 510, to maintain a high temperature of the housing. This will further reduce said temperature difference. For technical reasons relating to the construction, one heat transfer pipe 510' which in the normal design would extend in the wall 112, can be moved aside, out of the way for the housing 450 and the heat exchanger pipes 200 (210, 220). Advantageously, as shown in FIG. 3*b*, a distance is left between such a heat transfer pipe 510' moved aside and the housing 450, for thermally insulating the housing from said heat transfer pipe as well. This distance $d_2$ (FIG. 3*b*) can be, for example, at least 1 mm or at least 2 mm, such as at least 5 mm.

The presented housing 450 can also be applied in connection with such a heat exchanger pipe which does not comprise the outer pipe at all but only the first, at least partly insulated part. The presented housing 450 can also be applied in connection with a heat exchanger pipe that does not comprise a substantially straight outer pipe. Such a thermal device comprises at least a first wall delimiting a flow duct for gases, and a heat exchanger pipe comprising at least an inner pipe, at least the first section of said heat exchanger pipe being placed in said flow duct for gases and extending, in said flow duct from gases, from said first wall to said first wall or another wall delimiting the flow duct for gases, in such a way that (A)

the inner pipe 210 of the first section 202 of said heat exchanger pipe is, in some parts, insulated from the flow duct 115 for gases by means of said outer pipe 220 and/or an insulator 260, and the inner pipe 210 of the first section 202 of said heat exchanger pipe is noninsulated from the flow duct 115 for gases in one or more noninsulated areas 270 (FIG. 1*i*) in such a way that (A1)

the length of even the largest noninsulated area 270 of the first section 202 does not exceed 15 cm; advantageously, the length of even the largest noninsulated area 270 of the first section 202 does not exceed 10 cm, the length being measured in the longitudinal direction of the inner pipe; or (A2)

the distance from all the noninsulated areas 270 of the first section 202 to all the other heat recovery surfaces of the thermal device (other than the heat exchanger pipe 200 itself) is not greater than 15 cm, advantageously not greater than 10 cm; or (B)

the first section of said heat exchanger pipe or the inner pipe of the first section of said heat exchanger pipe is insulated over its entire length from the flow duct for gases by means of an outer pipe and/or an insulator.

Furthermore, the wall of the thermal device comprises a housing, the housing protruding outwards from the wall of the thermal device, seen from the flow duct for gases, the housing comprising a through hole for conveying said inner pipe out of the process area of the thermal device or from the flow duct for gases.

Said outer pipe can be connected to the inner surface of the housing. Insulator adjacent to the wall may extend from the inner surface of the housing to the flow duct for gases, for shielding the inner pipe of the heat exchanger pipe.

Figure 4A:
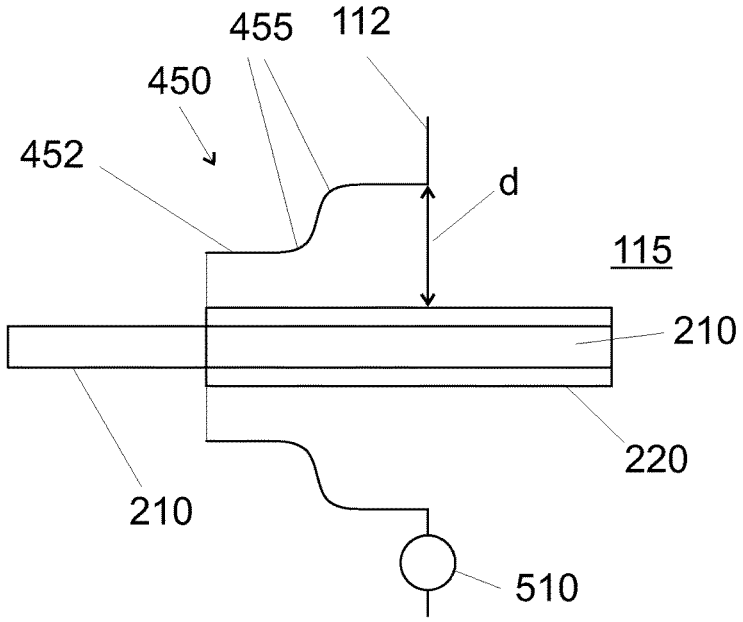
FIG. 4*a* shows a principle view of the area of a wall and a housing seen from above.
Figure 4B:
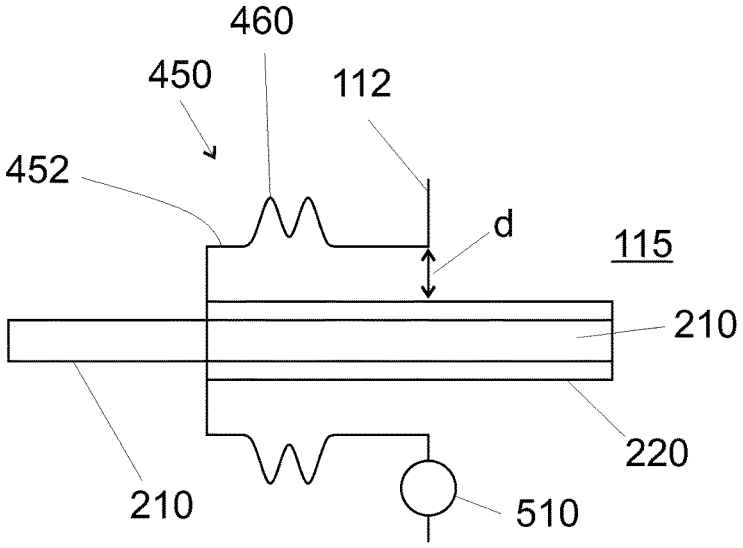
FIG. 4*b* shows a principle view of the area of a wall and a housing seen from above.

FIGS. 4*a* and 4*b* show some embodiments of the housing 450 seen from above. In the figures, the wall 452 of the housing constitutes a flexible structure in the housing 450, arranged to receive the thermal expansion of the thermal device 100 and the heat exchanger pipe 200.

For example FIG. 4*a* shows a housing 450 in a principle view from above. In the embodiment of FIG. 4*a*, at least one wall 452 of said housing 450 forms at least two bends 455, wherein said wall 452 of the housing 450 constitutes a flexible structure in the housing 450, arranged to receive the thermal expansion of the thermal device 100, such as the boiler 100 and the heat exchanger pipe 200.

Further, FIG. 4*b* shows an embodiment which receives the thermal expansion in a more efficient way. In the embodiment of FIG. 4*b*, at least one wall 452 of said housing 450 forms at least one fold 460 which deviates from the line of the wall of the housing 450, wherein said fold 460 constitutes a flexible structure in the housing 450, arranged to receive the thermal expansion of the thermal device, such as the boiler 100 and the heat exchanger pipe 200. The fold 460 converts the housing 450 into bellows, i.e. a tubular structure that becomes shorter and longer when pressed and pulled, respectively. The length of such a bellows-like housing 450 is arranged to change by the effect of thermal stresses.

The line of the wall of the housing 450 refers to a plane that is best fitted to the shape of the wall of the housing (with a fold). When the wall of the housing comprises a fold 460, it comprises at least three bends 455 (not shown with reference numerals in FIG. 4*b*).

In FIG. 4*b*, the housing 450 protrudes (deviates outwards) from the first wall 112 of the thermal device 100. Furthermore, the fold 460 protrudes from the line of the wall 452 of the housing 450 in such a way that the fold 460 extends in parallel with said first wall 112. Instead of protruding, the fold could deviate inwards into the housing 450 from the line of the wall 452. Furthermore, in the case of at least two folds, the first fold 460 can deviate outwards (protrude) and the second one inwards. In FIG. 4*b*, both walls of the housing 450 presented comprise two folds 460.

Above, receiving the thermal expansion of the thermal device 100 and the heat exchanger pipe 200 refers to the fact that even if the heat exchanger pipe 200 and the thermal device 100 (such as a boiler, for example a boiler wall) expand to a different extent due to the different operating temperatures and/or different heat expansion coefficients of the thermal device 100 and the heat exchanger pipe 200, no significant thermal stresses are formed in the structure because the structure is flexible, i.e. receives the thermal expansion. In such a structure, at least part of the wall 452 of the housing 450 is arranged to bend as a result of thermal stresses. When the wall 452 of the housing comprises a bend, as a result of thermal expansion the bend is straightened out or curved more, which requires considerably smaller stresses than, for example, expanding or compressing the straight wall of the housing 450 in the direction of the wall of the housing.

Figure 5:
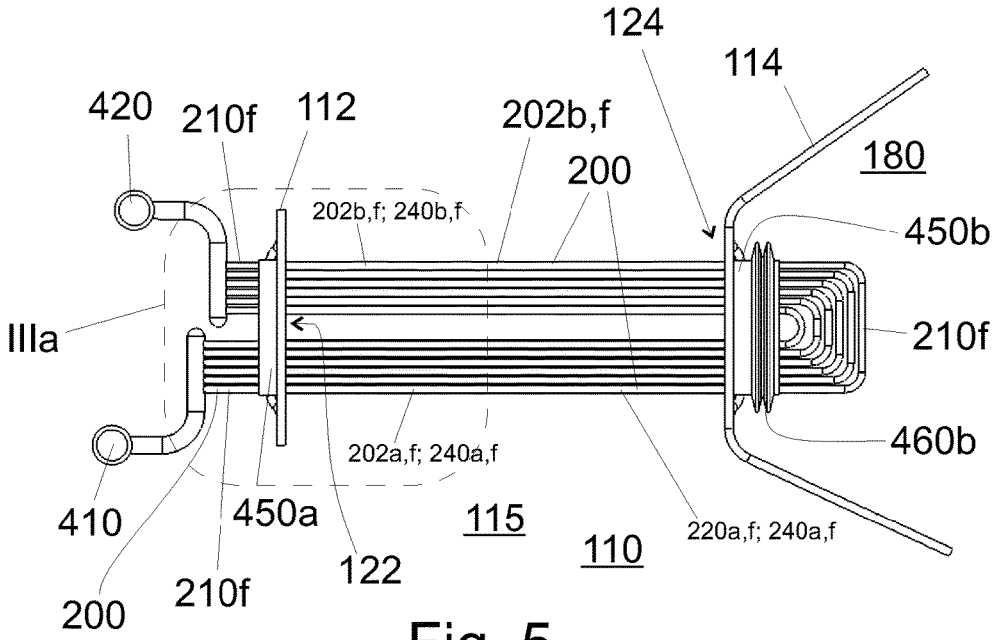
FIG. 5 shows a heat exchanger, i.e. a superheater pipe assembly or a superheater, in the flow duct for gases, seen from the side.

FIG. 5 shows yet another advantageous embodiment in a boiler. FIG. 5 shows a side view of a heat exchanger comprising heat exchanger pipes of the above described kind, and parts thereof. Part IIIa of FIG. 5 has been presented above in connection with FIG. 3*a*. The embodiment comprises several inner pipes 210*a* to 210*f*. Each inner pipe comprises a first first section and a second first section; for example, the inner pipe 210*f* comprises a first first section 202*a,f* and a second first section 202*b,f* The first sections 202*a,f* and 202*b,f* consist of the described second sections 240*a,f* and 240*b,f* (respectively); in other words, the second sections extend straight and comprise the outer pipes 220*a,f* and 220*b,f* respectively.

The heat exchanger pipe (such as the pipe 200) extends from the first wall 112 to the opposite wall 114 of the boiler. In FIG. 5, the heat exchanger pipe extends from the first wall 112 of the boiler to the nose 180 of the opposite wall 114, as shown in FIG. 2. The heat exchanger shown in FIG. 5 comprises several heat exchanger pipes 200 with a layered structure, shown in FIG. 1*b*, extending straight in the flow duct 115 for gases and bending outside the flow duct 115, in this case inside the nose 180 (cf. FIGS. 2 and 3*a*).

A housing 450*a* is provided in the first area 122 for conveying inner pipes 220, such as the inner pipe 210*f*, from the outside of the flow duct 115 for flue gases to the flow duct 115. Furthermore, on the side of the flow duct 115, the inner pipes are provided inside the outer pipes 220, such as the outer pipes 220*a,f* and 220*b,f*, as presented above. In a corresponding manner, a second housing 450*b* is provided in the second area 124, for conveying the inner pipe 210 out from the side of the flow duct 115 into the nose 180. The second housing 450*b* comprises two folds 460*b* for receiving thermal expansion.

In FIG. 5, several inner pipes 220 are conveyed through via the same housing. It is also possible to provide a single housing for each through hole for one pipe. Such a single housing can comprise, in the above described way, at least two bends 455, such as a fold 460. This arrangement provides the advantage that at an uneven operating temperature, each heat exchanger pipe 200 can expand in a different way because each single housing will receive the thermal expansion of each single pipe section 240, 240*b*.

The embodiment of FIG. 5 can also be implemented in a more general thermal device. In general, the thermal device shown in FIGS. 1 to 5 can be, for example, one of the following types:

a pyrolysis reactor, a gasification reactor, or a boiler, such as a fluidized bed boiler, for example a bubbling fluidized bed boiler or a circulating fluidized bed boiler; preferably a bubbling fluidized bed boiler.

In addition to the thermal device, a method has been presented above for heating a heat transfer medium. The method comprises:

producing gas heated by the thermal device 100, conveying said gas to a flow duct 115 for gases, introducing heat transfer medium to a heat exchanger pipe 200, at least a first section 202 of said heat exchanger pipe being placed in the flow duct 115 for gases and extending, in said flow duct 115 for gases, from the wall (112, 114) of said flow duct to the same (112, 114) or another (114, 112) wall of said flow duct 115, said first section 202 of the heat exchanger pipe comprising a second section 240 of the heat exchanger pipe, extending in said flow duct 115 for gases, and recovering heat into the heat transfer medium by means of said heat exchanger pipe 200.

In the method, the heat exchanger pipe 200 used for recovering heat is such that said second section 240 of the heat exchanger pipe 200 comprises at least part of an inner pipe 210 for transferring heat transfer medium from the first end to the second end of the part of the inner pipe, and for recovering heat by the heat transfer medium, an outer pipe 220 radially enclosing said part of the inner pipe 210, and a medium layer 230 placed between said outer pipe and said part of the inner pipe in the radial direction, and (A)

the inner pipe 210 of the first section 202 of said heat exchanger pipe is, in some parts, insulated from the flow duct 115 for gases by means of said outer pipe 220 and/or an insulator 260, and the inner pipe 210 of the first section 202 of said heat exchanger pipe is noninsulated from the flow duct 115 for gases in one or more noninsulated areas 270 (FIG. 1*i*) in such a way that (A1)

the length of even the largest noninsulated area 270 does not exceed 15 cm; advantageously, the length of even the largest noninsulated area 270 does not exceed 10 cm; the length being measured in the longitudinal direction of the inner pipe; or (A2)

the distance from all the points of the noninsulated areas 270 to the other heat recovery surfaces of the device (other than the heat exchanger pipe 200 itself) is not greater than 15 cm, advantageously not greater than 10 cm; or (B)

the first section 202 of said heat exchanger pipe 200, or the inner pipe 210 of the first section 202 of said heat exchanger pipe 200 is, over its entire length, insulated from the flow duct 115 for gases by means of said outer pipe 240 and/or an insulator 260.

In an advantageous embodiment of the method, the thermal device comprises several other heat transfer pipes inside the walls of the flow duct for gases, for recovering heat. Said heat exchanger pipe and said other heat transfer pipes constitute a continuous flow duct for the heat transfer medium, for heating the heat transfer medium.

In such an embodiment, (C,i)

said flow duct for heat transfer medium comprises a first section of said heat exchanger pipe as the heat transfer element placed last in the flow duct for gases in the flow direction of the heat transfer medium, or (C,ii)

said flow duct for the heat transfer medium comprises the first section of the heat exchanger pipe placed last in the flow duct for gases, in the flow direction of the heat transfer medium, and at least one heat transfer pipe placed downstream in the subsequent flow duct for gases, in the direction of flow of the heat transfer medium, and said first section of the heat exchanger pipe placed last is arranged, in the flow direction of the gas flowing outside the outer pipe, upstream of said heat transfer pipes placed downstream in the flow duct for gases in the flow direction of the heat transfer medium.

In an advantageous embodiment of the method, said second section 240 of the heat exchanger pipe extends in a straight line or bends less than 90 degrees.

In an embodiment of the method, said second section 240 of the heat exchanger pipe bends at least 90 degrees.

Features of the method relating to temperatures have been presented above in connection with the use of the device. Features of the method relating to the supply of auxiliary agent have been presented above in connection with the use of the device. Technical features of structures used in the method have been presented above as features of the thermal device.

The invention claimed is:

1. A thermal device comprising at least a first wall delimiting a flow duct for gases; and a heat exchanger pipe comprising at least an inner pipe, at least a first first section of said heat exchanger pipe being placed in said flow duct for gases and extending in said flow duct for gases from said first wall to said first wall or to a second wall delimiting the flow duct for gases;

the heat exchanger pipe comprising a second first section extending in said flow duct for gases from one wall to the same or another wall; and several other heat transfer pipes inside the walls of the flow duct for gases, for recovering heat, in which thermal device;

said first first section of the heat exchanger pipe comprises:

a second section of the heat exchanger pipe, extending in said flow duct for gases, wherein said second section of the heat exchanger pipe comprises:

at least a section of the inner pipe, for transferring heat transfer medium from the first end to the second end of the inner pipe and for recovering heat by the heat transfer medium, an outer pipe which radially encloses said section of the inner pipe, and a medium layer placed between said outer pipe and said section of the inner pipe in the radial direction; and said heat exchanger pipe and said other heat transfer pipes constitute a continuous flow duct for the heat transfer medium, for heating the heat transfer medium, in which thermal device (A,i) the inner pipe of the first first section of said heat exchanger pipe is non-insulated from the flow duct for gases in one or more non-insulated areas in such a way that the distance from all points of the non-insulated areas of the first first section to the other heat recovery surfaces of the thermal devices is not greater than 15 cm; or (A,ii) said first first section of the heat exchanger pipe, or the inner pipe of said first first section of the heat exchanger pipe, is insulated, over its entire length, from the flow duct for gases by means of said outer pipe and/or an insulator, and (B,i) the second first section or its inner pipe is non-insulated from the flow duct for gases in one or more non-insulated areas in such a way that the distance from all the points in the non-insulated areas of the second first section to the other heat recovery surfaces of the device is not greater than 15 cm; or (B,ii) the second first section or the inner pipe of said second first section is, over its entire length, insulated from the flow duct for gases by means of a second outer pipe and/or an insulator, wherein (C,i) said flow duct for the heat transfer medium comprises the first first section of said heat exchanger pipe as the heat transfer element placed last in the flow duct of gases, in the direction of the flow of the heat transfer medium, or (C,ii) said flow duct for the heat transfer medium comprises the first first section of the heat exchanger pipe placed last in the flow duct for gases, in the flow direction of the heat transfer medium, and at least one heat transfer pipe placed downstream in the flow duct for gases, in the direction of flow of the heat transfer medium, and said first first section of the last heat exchanger pipe is arranged, in the flow direction of the gas flowing outside the outer pipe, upstream of said heat transfer pipes placed downstream in the flow duct for gases in the flow direction of the heat transfer medium, and (D) said inner pipe connects said first first section of the heat exchanger pipe to said second first section of the heat exchanger pipe outside said flow duct for gases, said second first section of the heat exchanger pipe is placed downstream of said first first section of the heat exchanger pipe in the flow direction of the medium flowing in the inner pipe, and said second first section of the heat exchanger pipe is placed downstream of said first first section of the heat exchanger pipe in the flow direction of the gas flowing outside the heat exchanger pipe.

2. The thermal device according to claim 1, wherein said second section of the heat exchanger pipe extends in a straight line or bends less than 90 degrees; or said second section of the heat exchanger pipe bends at least 90 degrees.

3. The thermal device according to claim 1, wherein said second section of the heat exchanger pipe extends from said first wall of the device to said flow duct for gases; advantageously, said second section of the heat exchanger pipe comprises said first first section of the heat exchanger pipe.

4. The thermal device according to claim 1, wherein said first first section of the heat exchanger pipe comprises a thermally insulated section in said flow duct for gases, in which thermally insulated section the inner pipe is not enclosed by an outer pipe, and in which thermally insulated section the inner pipe is thermally insulated from the gases in the flow duct by means of a thermal insulator, or the inner pipe is enclosed by an outer pipe, and in said thermally insulated section the outer pipe is thermally insulated from the gases in the flow duct by means of a thermal insulator.

5. The thermal device according to claim 4, wherein (A)

said second section of the heat exchanger pipe extends from said first wall of the device to said thermally insulated part, or (B)

the thermal device comprises an insulator adjacent to the wall, extending from said first wall of the device to the flow duct for gases, said second section of the heat exchanger pipe extends from said insulator adjacent to the wall to said thermally insulated section, and said insulator adjacent to the wall is configured to insulate at least the inner pipe of the heat exchanger pipe from the flow duct for gases.

6. The thermal device according to claim 1, wherein said first first section of the heat exchanger pipe is horizontal, or the longitudinal part of said first first section of the heat exchanger pipe forms, at each point, and angle smaller than 30 degrees to the horizontal plane.

7. The thermal device according to claim 1, comprising means for feeding an auxiliary agent, for feeding an auxiliary agent to the process, the part of the means for feeding an auxiliary agent being placed in the flow duct for gases, and part of the means for feeding an auxiliary agent being arranged down-stream of said or a first first section of said heat exchanger pipe in the flow direction of gases.

8. The thermal device according to claim 7, comprising a first heat exchanger comprising said heat exchanger pipe and further several heat exchanger pipes which comprise an inner pipe, at least one outer pipe and a medium layer placed between the outer pipe and the inner pipe parts, a second heat exchanger comprising several heat transfer pipes, the first heat exchanger being arranged upstream of said second heat exchanger in the flow direction of gases, the second heat exchanger being spaced from the first heat exchanger, wherein a space is left between the second heat exchanger and the first heat exchanger, and said part of the means for feeding an auxiliary agent being arranged in said space.

9. The thermal device according to claim 1, wherein the wall of the thermal device comprises a housing, the housing protrudes outwards from the wall of the thermal device, seen from the flow duct for gases, the housing comprises a through hole for conveying said inner pipe out of the process area of the thermal device or from the flow duct for gases, and (i) the outer surface of the housing is provided with said outer pipe, (ii) an insulator adjacent to the wall extends from the inner surface of the housing to the flow duct for gases; or (iii) said non-insulated area of the first first section extends from the inner surface of the housing to the flow duct for gases, for shielding the inner pipe of the heat exchanger pipe.

10. The thermal device according to claim 9, wherein a distance is left between the inner surface of said housing and the outer surface of said outer pipe;

a distance is left between the inner surface of said housing and the insulator adjacent to said wall; or a distance is left between the inner surface of said housing and said non-insulated area;

wherein said inner pipe is thermally insulated from the wall of the thermal device, because such a distance thermally insulates the heat exchanger pipe from the wall of the thermal device.

11. The thermal device according to claim 9, wherein said wall of the housing constitutes a flexible structure in the housing, arranged to receive the thermal expansion of the thermal device and the heat exchanger pipe.

12. The thermal device according to claim 1, wherein the wall of the device comprises a nose which makes the flow duct for gases narrower, and said first first section of the heat exchanger pipe extends from said nose.

13. The thermal device according to claim 1, the thermal device being one of the following types:

a pyrolysis reactor, a gasification reactor, or a boiler.

14. A method for heating a heat transfer medium, the method comprising:

producing gas heated by a thermal device, conveying said gas into a flow duct for gases, conveying heat transfer medium into a heat exchanger pipe comprising at least an inner pipe, at least the first first section of the heat exchanger pipe being placed in the flow duct for gases and extending in said flow duct for gases from the wall of said flow duct to the same or another wall of said flow duct, and said first first section of the heat exchanger pipe comprising a second section of the heat exchanger pipe, extending in said flow duct for gases, and a second first section extending in said flow duct for gases from one wall to the same or another wall, recovering heat by the heat transfer medium by means of said heat exchanger pipe, in which method the thermal device comprises several other heat transfer pipes inside the walls of the flow duct for gases, for recovering heat, said second section of the heat exchanger pipe comprises at least a section of the inner pipe for transferring heat transfer medium from the first end to the second end of the inner pipe and for recovering heat by the heat transfer medium, an outer pipe which radially encloses said section of the inner pipe, and a layer of medium left between said outer pipe and said part of the inner pipe in the radial direction, said heat exchanger pipe and said other heat transfer pipes constitute a continuous flow duct for the heat transfer medium, for heating the heat transfer medium, and the inner pipe of the first first section of said heat exchanger pipe is non-insulated from the flow duct for gases in one or more non-insulated areas in such a way that the distance from all points of the non-insulated areas of the first first section to the other heat recovery surfaces of the thermal devices is not greater than 15 cm; or said first first section of the heat exchanger pipe, or the inner pipe of said first first section of the heat exchanger pipe, is insulated, over its entire length, from the flow duct for gases by means of said outer pipe and/or an insulator, and the second first section or its inner pipe is non-insulated from the flow duct for gases in one or more non-insulated areas in such a way that the distance from all the points in the non-insulated areas of the second first section to the other heat recovery surfaces of the device is not greater than 15 cm; or the second first section or the inner pipe of said second first section is, over its entire length, insulated from the flow duct for gases by means of a second outer pipe and/or an insulator, wherein said flow duct for the heat transfer medium comprises the first first section of said heat exchanger pipe as the heat transfer element placed last in the flow duct of gases, in the direction of the flow of the heat transfer medium, or said flow duct for the heat transfer medium comprises the first first section of the heat exchanger pipe placed last in the flow duct for gases, in the flow direction of the heat transfer medium, and at least one heat transfer pipe placed downstream in the flow duct for gases, in the direction of flow of the heat transfer medium, and said first first section of the last heat exchanger pipe is arranged, in the flow direction of the gas flowing outside the outer pipe, upstream of said heat transfer pipes placed downstream in the flow duct for gases in the flow direction of the heat transfer medium, and said inner pipe connects said first first section of the heat exchanger pipe to said second first section of the heat exchanger pipe outside said flow duct for gases, said second first section of the heat exchanger pipe is placed downstream of said first first section of the heat exchanger pipe in the flow direction of the medium flowing in the inner pipe, and said second first section of the heat exchanger pipe is placed downstream of said first first section of the heat exchanger pipe in the flow direction of the gas flowing outside the heat exchanger pipe.

15. The method according to claim 14, wherein said second section of the heat exchanger pipe extends in a straight line or bends less than 90 degrees, or said second section of the heat exchanger pipe bends more than 90 degrees.

16. The method of claim 14, wherein heat transfer medium is allowed to flow in said inner pipe, steam is used as the heat transfer medium, and the temperature of the heat transfer medium flowing in the inner pipe is at least 500° C.

17. The method of claim 16, wherein the temperature of an outer surface of the outer pipe is higher than 600° C.

18. The method of claim 14, wherein the temperature of an outer surface of the outer pipe is higher than 600° C.

19. The method of claim 14, wherein the thermal device comprises means for feeding an auxiliary agent, for feeding an auxiliary agent to the process, the part of the means for feeding an auxiliary agent being placed in the flow duct for gases, and part of the means for feeding an auxiliary agent being arranged down-stream of said or a first first section of said heat exchanger pipe in the flow direction of gases, the method comprising supplying the thermal device with an auxiliary agent by said means of said heat exchanger pipe, wherein the auxiliary agent comprising at least one of the following: ammonia ($NH_3$), ammonium ion ($NH_4^+$), ferric sulphate ($Fe_2(SO_4)_3$), ferrous sulphate ($FeSO_4$), aluminium sulphate ($Al_2(SO_4)_3$) ammonium sulphate ($(NH_4)_2SO_4$), ammonium hydrogen sulphate ($(NH_4)HSO_4$), sulphuric acid ($H_2SO_4$), and sulphur (S), as well as aqueous solutions of these.

20. The thermal device according to claim 13 wherein the boiler is a bubbling fluidized bed boiler.

21. The method of claim 16 wherein the temperature of the heat transfer medium flowing in the inner pipe is greater than 530° C.

* * * * *